US005988274A

United States Patent [19]

Funk

[11] Patent Number: 5,988,274

[45] Date of Patent: Nov. 23, 1999

[54] METHOD OF AND APPARATUS FOR INSERTING PIPES AND TOOLS INTO WELLS

[76] Inventor: Kelly Funk, 301 Mount Royal Place, Nanaimo, British Columbia, Canada, V9R 6A4

[21] Appl. No.: 08/903,027

[22] Filed: Jul. 30, 1997

[51] Int. Cl.[6] ..... E21B 19/08

[52] U.S. Cl. ..... 166/77.4; 166/77.53; 254/29 R

[58] Field of Search ..... 166/77.4, 77.53, 166/85.4, 70, 379, 381, 383; 254/29 R

[56] References Cited

U.S. PATENT DOCUMENTS 1,586,923 2/1926 Townsend ..... 166/77.4

3,096,075 7/1963 Brown ..... 166/77.4

4,162,704 7/1979 Gunther ..... 166/77.53

5,020,590 6/1991 McLeod ..... 254/29 R

*Primary Examiner*—David Bagnell

*Assistant Examiner*—Sunil Singh

[57] ABSTRACT

A snubbing configuration for inserting a pipe and/or a tool assembly on a pipe into a live well head employs a telescopic cylinder, e.g. a telescopic snubbing jack, between an upper BOP, e.g. an annular BOP, and a lower BOP, e.g. a double-gate BOP, in place of a conventional stripping BOP and an extended spool which are required in conventional configurations to accommodate long tool assemblies.

34 Claims, 27 Drawing Sheets

PRIOR ART

METHOD OF AND APPARATUS FOR INSERTING PIPES AND TOOLS INTO WELLS

BACKGROUND OF THE INVENTION

1. Field of the Invention

The present invention relates to methods and apparatus for inserting pipes and/or tools into live well bore while maintaining pressure in the well bores and, also, to snubbing jack assemblies for use therein.

2. Description of the Related Art

All snubbing or live well operations require blowout preventors (BOPs) or other sealing devices to maintain the well pressure while operations take place. A standard blowout preventor configuration includes, from the bottom up, a double-gate BOP complete with blind rams that shut the flow of the well off in the event that there is no pipe or tools in the well bore; a set of pipe rams directly above the blind rams, within an double-gate BOP, that seals off the flow of the well in the event that there is pipe in it; a single gate stripping ram preventor, which is used when pipe is in the well and which is necessary to install tools into the well bore and/or land the tubing hanger into the well head; an equalizing spool complete with two ports and valving off each port for equalizing and bleeding off the pressure from with in the BOP configuration; and an annular BOP installed on the top of the equalizing spool. The annular blowout preventor is for sealing around the pipe while the pipe being inserted into the well, as well as sealing around non-standard shapes of tools, etc. Such tools may, for example, comprise bottom hole assemblies comprising combinations of different tools, which are site-specific, e.g. for setting-up wells and, performing remedial maintenance prior to actual production for assisting in the production of hydrocarbons from the wells. Plugs, packers, nipples, sleeves and blast joints are just some of the many tools that may be required in a typical bottom hole assembly. A single zone well may require nothing more than a profiled nipple with a plug in place to seal the flow of the fluid or gas from flowing up the tubing while it is being installed into the well while maintaining the well pressure at surface. When the tubing has been positioned to the desirable depth in the well and landed into the well head, the plug is recovered from the nipple, allowing flow up the tubing. The nipple may later be used to suspend pressure recorders (tools) in the well to monitor pressures of the zone while in a static and or flowing position. A dual-zoned well typically requires a nipple and plug to stop the flow during insertion of production tubing as well as a packer, a sliding sleeve and possibly a blast joint. The packer serves as a sealing device to segregate the two zones, so the top zone can be produced up the casing or annulus (the space between the tubing and casing) and the lower zone produced up the tubing simultaneously. The sliding sleeve functions as a device to be able to equalize differential pressures between the zones to assist in pulling or retrieving tools (plugs, pressure recorders etc.) from the profiled nipple as well as establishing communication between the tubing and casing to flow back or displace fluid, gas and or other materials from the top zone (above the packer) up the tubing. Because of the smaller inside diameter and ultimately the volume required to fill the tubing, a more desirable flow rate and pressure can typically be maintained while the flow back is taking place. Many zones have high static (shut in) pressures, but don't necessarily produce the volume required to fill larger areas such as the annulus fast enough to establish desirable a rate of flow. Many formations can be severely and irreversibly damaged when the pressure from the producing zone is flowed back at a rate faster then that of which the hydrocarbons can pass through the zone (rock, sand, clay etc.) drawing in water or oil from below the zone and restricting flow. The blast joint may serve as a tool to protect the tubing from the erosive effects the flow of fluid and/or particles of sand etc. in to the annulus.

The conventional method of lubricating or stripping-in, i.e insertion into a live well through the well head, is achieved by closing the stripping rams around the pipe, then bleeding off the pressure above. The annular BOP is then opened and the pipe and the tool assembly are lowered (i.e. the pipe is stripped through the stripping rams) into a space provided between the stripping rams and the annular BOP. When the tool assembly is in position, the annular BOP is closed and the pressure is equalized between the stripping rams and the annular BOP. The stripping rams are then opened. Normal operations then continue until the job has been completed.

In the event that the tools required to be lubricated into the well are longer than the space available in a conventional BOP configuration, an extended lubricating spool is installed to facilitate them.

SUMMARY OF THE INVENTION

It is an object of the present invention to provide a novel and advantageous method and apparatus which eliminate the need for a stripping BOP in the equipment described above, as well as any need for an extended lubricating spool, in most basic live well applications.

According to the present invention, a housing is provided between upper and lower blowout preventors or other sealing devices which is telescopically extendible to accommodate therein pipe and/or tools lowered past the upper sealing device.

The telescopic housing may of any suitable length, depending on the application. Tools to be lubricated or stripped into the well may be anywhere along the string of the pipe, depending on the application. Generally, tools are connected at the bottom of a first joint of tubing, before it is inserted into the well bore, or on the top of the tubing string to suspend the pipe at a well head.

The tools are firstly positioned just above the upper sealing device, e.g. an annular BOP. Safety pipe or the blind rams in the lower sealing device, e.g. a double gate BOP, are closed and pressure is bled off above (depending on whether or not there is pipe in the well). With the BOP open, the telescopic housing, is then extended, creating lubricating space to house or accommodate the a portion of the pipe and/or tools. The annular BOP actually moves in an upward direction to a position above the tools, thus lubricating (housing) the tools inside the telescopic housing. If the tools being run in the well are attached to the end of the pipe (vs. a point in the string other than the end), the housing would be fully extended and the tools lowered into the housing. The BOP is then closed into sealing engagement with the pipe above the tools. The pressure is equalized on both sides of rams in the lower BOP, the rams are opened, and the tools are then lowered into the well. Once the tools are clear of the BOPs, the telescopic spool is contracted back to its original position.

The benefits to this method according to the present invention, as compared to conventional prior art methods, is that the pipe never moves inside the BOPs while rams are closed, eliminating any need for a stripping BOP or for an extended lubricating spool. This significantly reduces the working height of the overall operation. When an extended lubricating spool is required for conventional lubricating applications for long tool assemblies, it is normally left in position until the completion of the job because of the extra time and money associated with its removal. The present telescopic cylinder provides this extended lubricating space without the extra height required to install the conventional extended lubricating spool.

In a preferred embodiment of the present invention, equipment is installed on top of the double-gate BOP from the bottom up in the following order.

1. A set of hydraulically actuated slips which have been designed to grip the pipe, while internally maintaining well pressure.
2. A two-port equalizing spool complete with a valve attached to each port to enable equalizing and bleed-off procedures.
3. The telescopic housing in the form of a hydraulically extendible telescopic cylinder with a outside diameter of 12–16 inches and an internal inside diameter of appropriate size (normally 7 1/16 inches through-bore in most operations). The outside diameter is determined by the size of the internal piston required and the hydraulic operating pressures at which the telescopic cylinder will operate, which are all relative to the lift and push forces for which the telescopic cylinder is designed. The overall length of the cylinder when contracted is desirably five to eight feet, for practical reasons. Extended, the telescopic cylinder would measure approximately nine to fifteen feet in length.
4. Upper slips located directly on top of the cylinder, then an annular BOP or a stripping BOP directly on top of the upper slips.

This equipment preferably stands approximately seven to eight feet tall, when contracted, using a five foot cylinder and is mounted directly on top of the standard lower BOP which, in turn, is attached to the wellhead. This relatively small height is one of the advantages provided by the present invention in contrast to the shortest conventional snubbing unit in use at the present time, which are twelve and a half to sixteen feet in length, measured from the bottom of the lower BOP to the top set of slips.

The telescoping action of the cylinder, in conjunction with the slips, functions to firstly grip the pipe with the lower slips. Then, after extending the telescopic cylinder upwardly and gripping the pipe with the top set of slips, the bottom set of slips are released and the cylinder is contracted, which lowers or forces the pipe into the well.

When tools are required to be inserted into the well, they are located just above the upper BOP with the latter closed, the safety rams are closed and the pressure is bled off between them and the BOP. The BOP is opened, the telescopic cylinder is extended over top of the tools. The BOP is closed, the pressure is equalized and the tools are lowered into the well.

The present method and apparatus make it possible to perform all operations from reasonable working heights with less rig-up time. The complete apparatus will fit through a standard opening in a service rig work floor or substructure on a drilling rig. Under normal conditions, the present apparatus will allow rig crews to take their places on the rig floor when inserting pipe into wells. Because of the inherent danger of working high in the air, as well as standing directly over top of a pressured well, oil companies and rig contractors generally rely on specially trained personnel to perform these tasks. The present invention eliminates any need for an extra man (a specialized snubbing assistant), better utilizes existing rig personnel, and is much safer because of the reduced working heights and because the operator stands away from the well bore and can operate the equipment remotely. In case of equipment failures, no persons are in the direct line of fire from escaping high-pressure gas, fluid and/or pipe.

BREIF DESCRIPTION OF THE DRAWINGS

The present invention will more readily understood by those skilled in the art from the following description thereof taken in conjunction with the accompanying diagrammatic drawings, in which.

Figure 14:
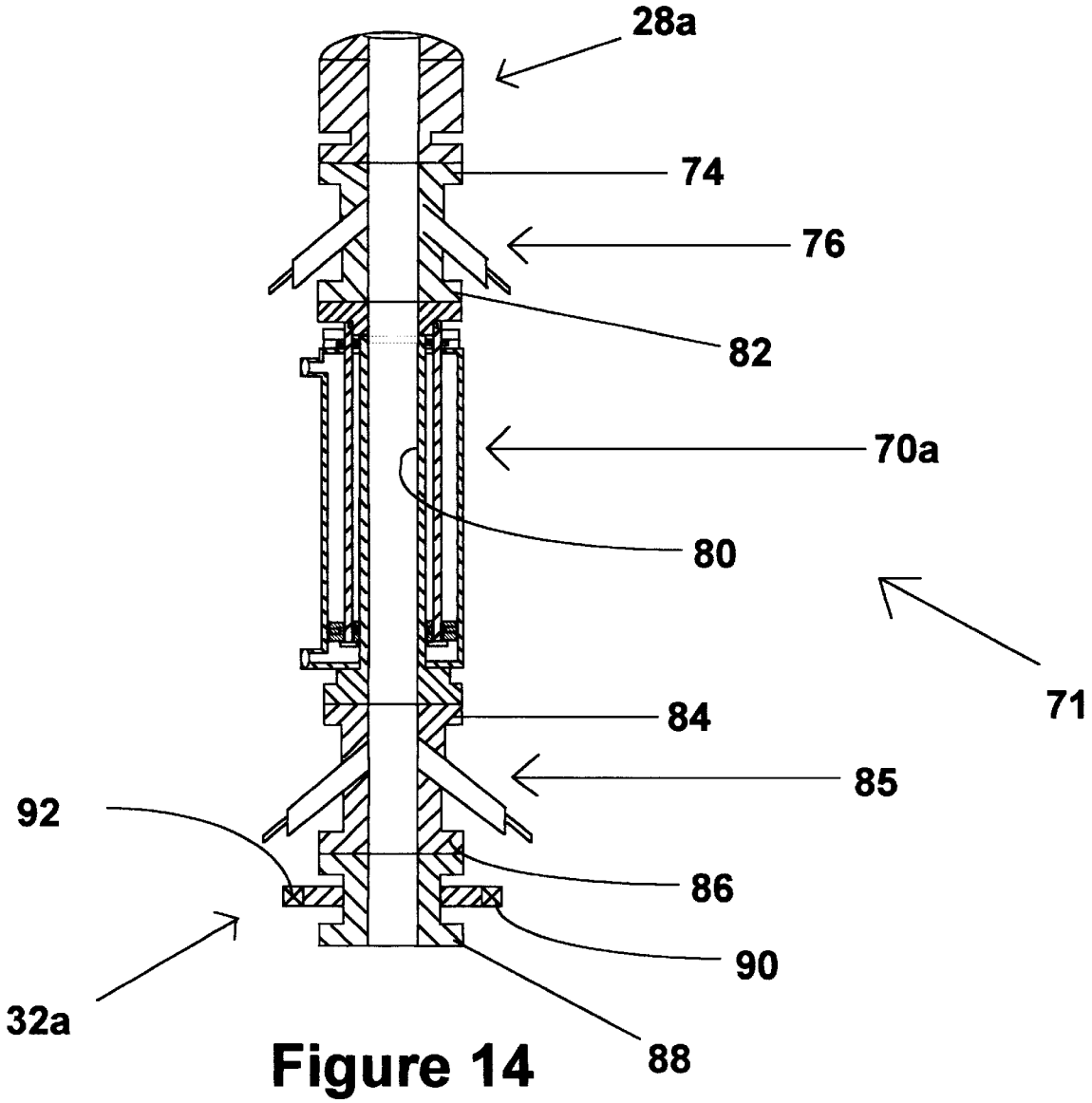
FIGS. 14 and 15 show diagrammatic views taken in longitudinal section through a snubbing configuration, according to the present invention, in a retracted condition and an extended condition, respectively.
Figure 15:
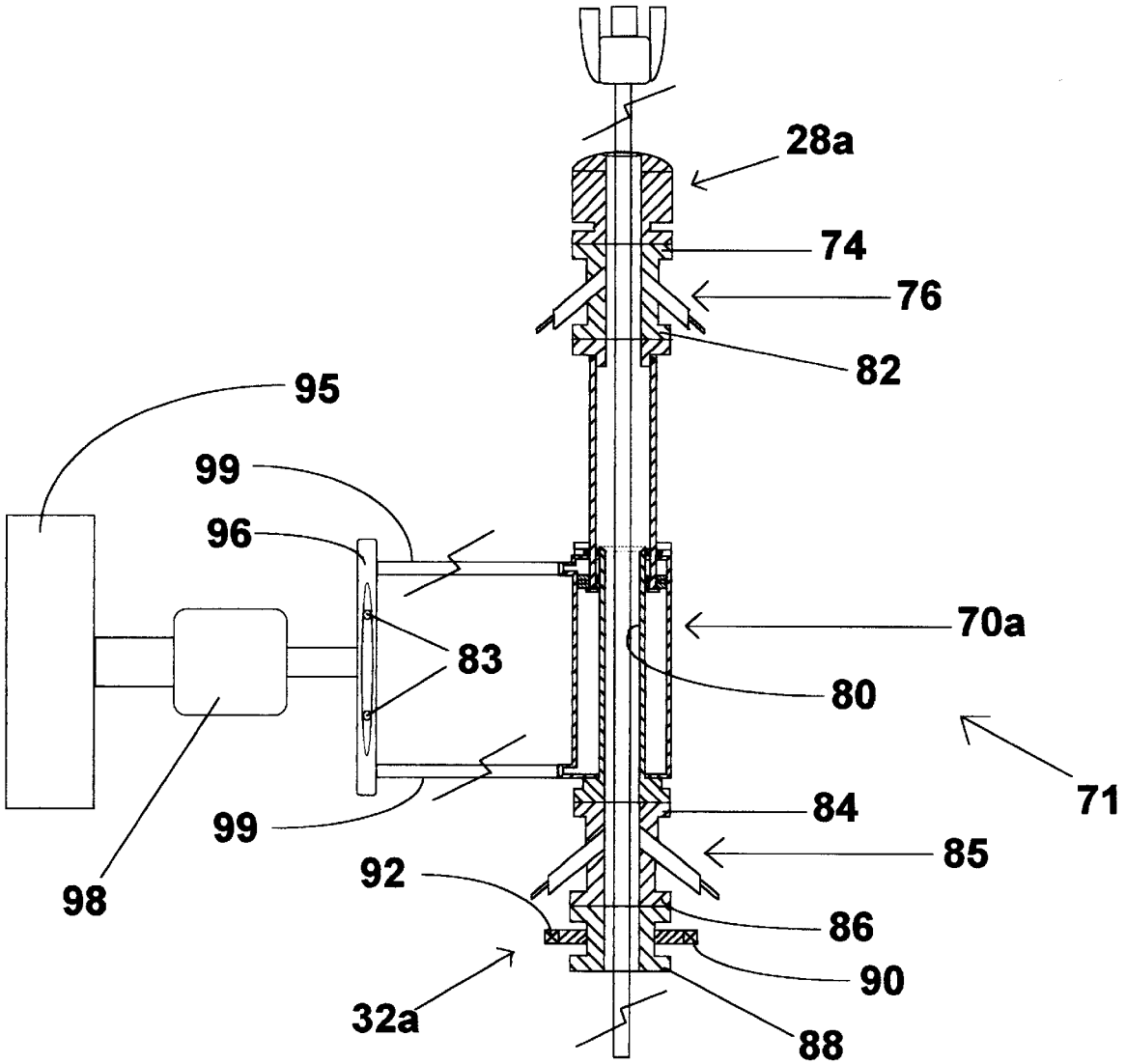
Figure 16:
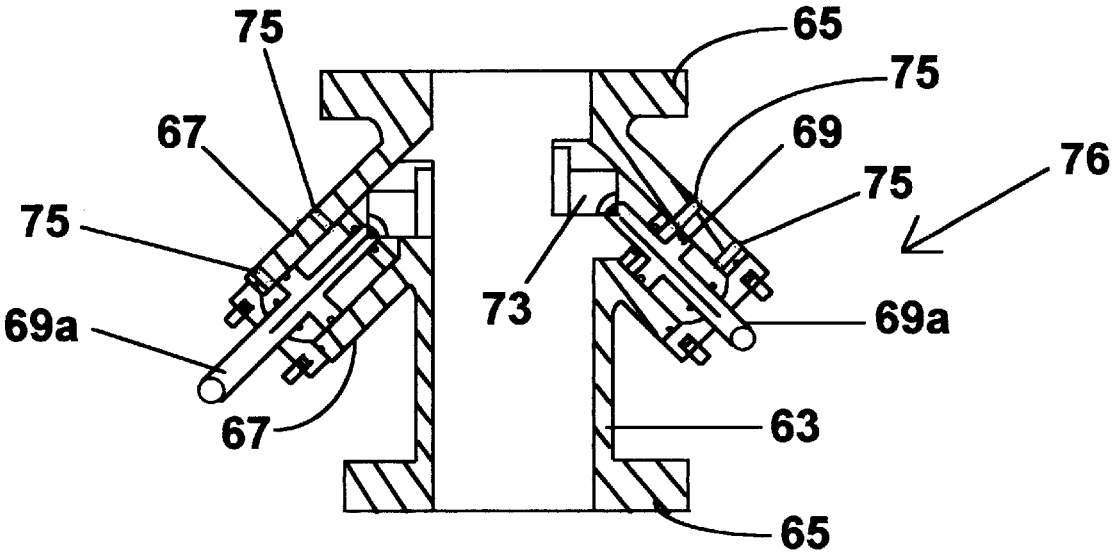

FIG. 16 shows a view in longitudinal cross-section through a snubbing slip assembly forming part of the configuration of FIGS. 14 and 15; and FIGS. 17 through 27 show successive stages in the insertion of a tool assembly into a live well through the snubbing configuration of FIGS. 14 and 15.

DESCRIPTION OF PRIOR ART

Figure 1:
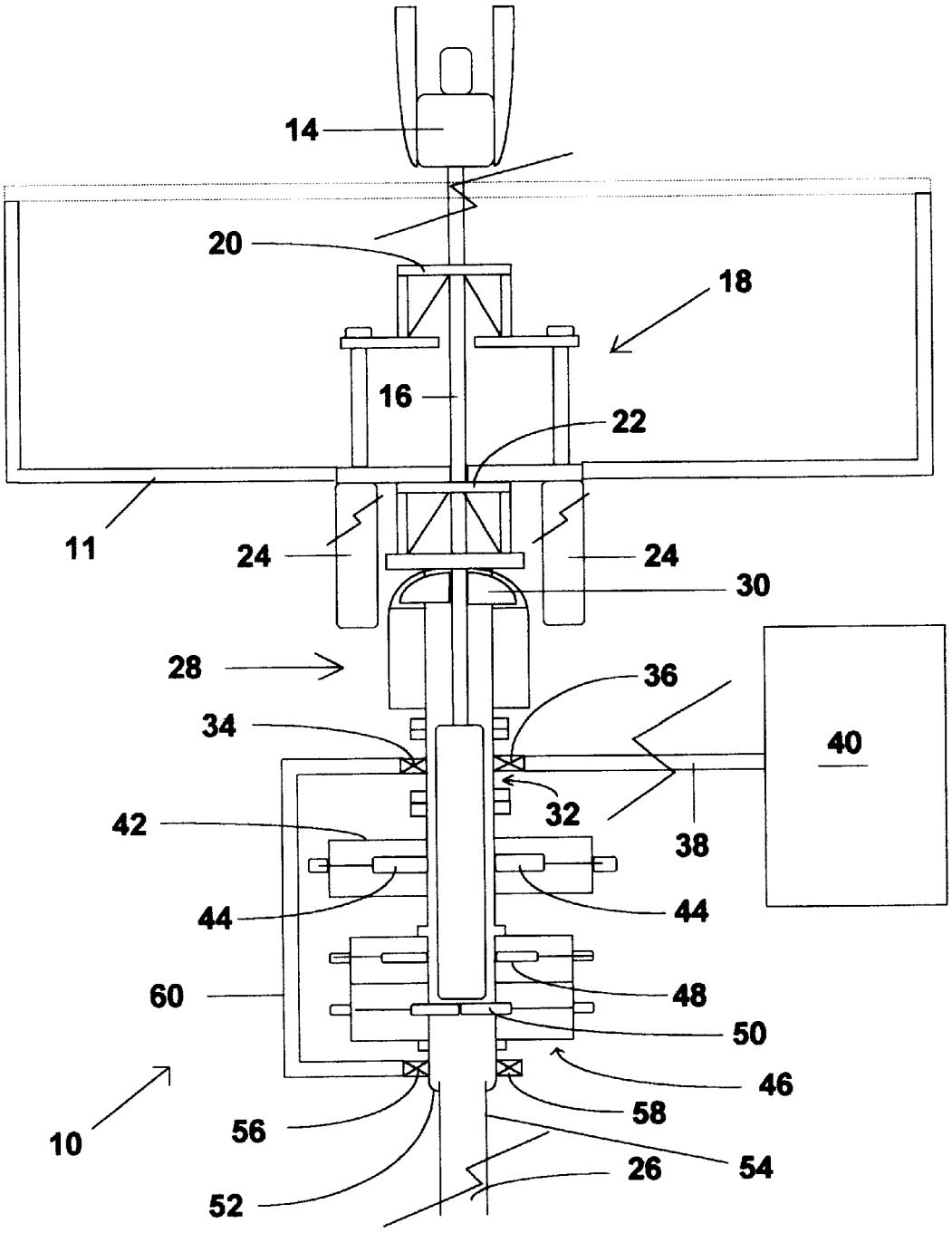
FIGS. 1 through 7 show successive steps in the insertion of a tool assembly into a live well through a conventional prior art snubbing configuration.

In the accompanying drawings, FIG. 1 illustrates a conventional snubbing configuration, indicated generally by reference numeral 10, with a work floor 11 that would normally be provided on top of a conventional hydraulic snubbing unit (jack) indicated generally by reference numeral 18. Elevators 14 are used to hold a pipe 16 while raising or lowering the pipe 16. The hydraulic snubbing jack 18 includes two sets of inverted (upside-down) slips 20 and 22 that grip the pipe.

During snubbing operations, the jack 18 operates with a hand-over-hand motion. The lower slips 22 are closed to grip the pipe in a stationary positions. The upper slips 20 are then opened and the jack 18 is extended upward to the top of stroke of its cylinder 24. The upper slips 20 are then closed, and the jack 18 is hydraulically forced downward, which forces the pipe 16 into a well bore 26. The lower slips 22 are opened when the upper slips 20 have control of the pipe 16. This action is continued until the pipe 16 reaches a heavy position in the well bore 26, i.e. a point where the weight of the pipe overcomes the hydraulic effect of the well pressure on the cross-sectional area of the pipe. The lower end of the pipe 16 is always plugged-off.

An upper BOP in the form of an annular BOP (blowout preventor) or stripping head indicated generally by reference numeral 28 comprises a steel-bodied assembly with a rubber sealing element 30, which is hydraulically actuated and which seals around the outside of the pipe 16 to maintain well pressure below the sealing element 30. Some stripping heads are designed to be hydraulically activated by the force of the well pressure across the area of the element. In that case, the greater the well pressure, the greater the resultant force and, thus, the better the seal around the pipe 16.

An equalizing spool indicated generally by reference numeral 32 is flanged on each end to connect to other wellhead or blowout preventor components. Various connecting systems are available for these components, e.g so-called Greylock Hubs. The spool 32 has two ports (not shown-one on each side) with valves 34, 36 on these ports. Valve 34 is used to equalize the pressure between two BOPs; the other valve 36 is used to bleed off the pressure between the two BOPs as described below. In FIG. 1, a bleed-off line 38 is shown leading from the valve 36 to a tank 40 located away from the well bore 26 at a location where gas could be safely dispersed. The valves 34 and 36 are either manually or hydraulically actuated.

A single-gate stripping BOP, which is indicated generally by reference numeral 42, is hydraulically actuated. The BOP 42 has opposing stripping rams 44 with inserts (not shown), for which Nylon or Garlock is the typical material used. The rams 44 are specifically sized to conform to the nominal size of the of the pipe 16 being installed in the well bore 26. When the rams 44 are closed on the pipe 16, the pressure is sealed below and the pipe can be moved up or down between couplings (not shown), i.e. locations at which one pipe section or tube connects to another.

An hydraulically actuated lower blowout preventor in the form of a double-gate BOP, indicated generally by reference numeral 46, has two sets of sealing rams 48 and 50. The top set of sealing rams 48 are the safety pipe rams, and are specifically sized to fit the pipe size, but are not intended for moving the pipe 16 through them on a regular basis. The purpose of these rams 48 is to seal off the well pressure below and to secure the well bore 26 when there is pipe in it. In case of any equipment failure above these rams 48, they are the only safety mechanism to maintain control of the well pressure. Therefore, the rams 48 are commonly referred to as safety rams. The lower set of rams 50 are blind rams used to close in and maintain control of the well bore 26 when there is no pipe in it.

A standard wellhead in the form of a casing bowl 52 is attached to a production casing 54 which runs the total depth of the well bore 26. The casing bowl 52 has two ports with two valves 56 and 58, one attached to each port. The valves 56 and 58 are intended to provide access to the well bore 26 for production and/or remedial purposes. In this application, the valve 56 is used to attach a line 60 extending from the casing bowl 52 to the equalizing spool 32.

Figure 2:
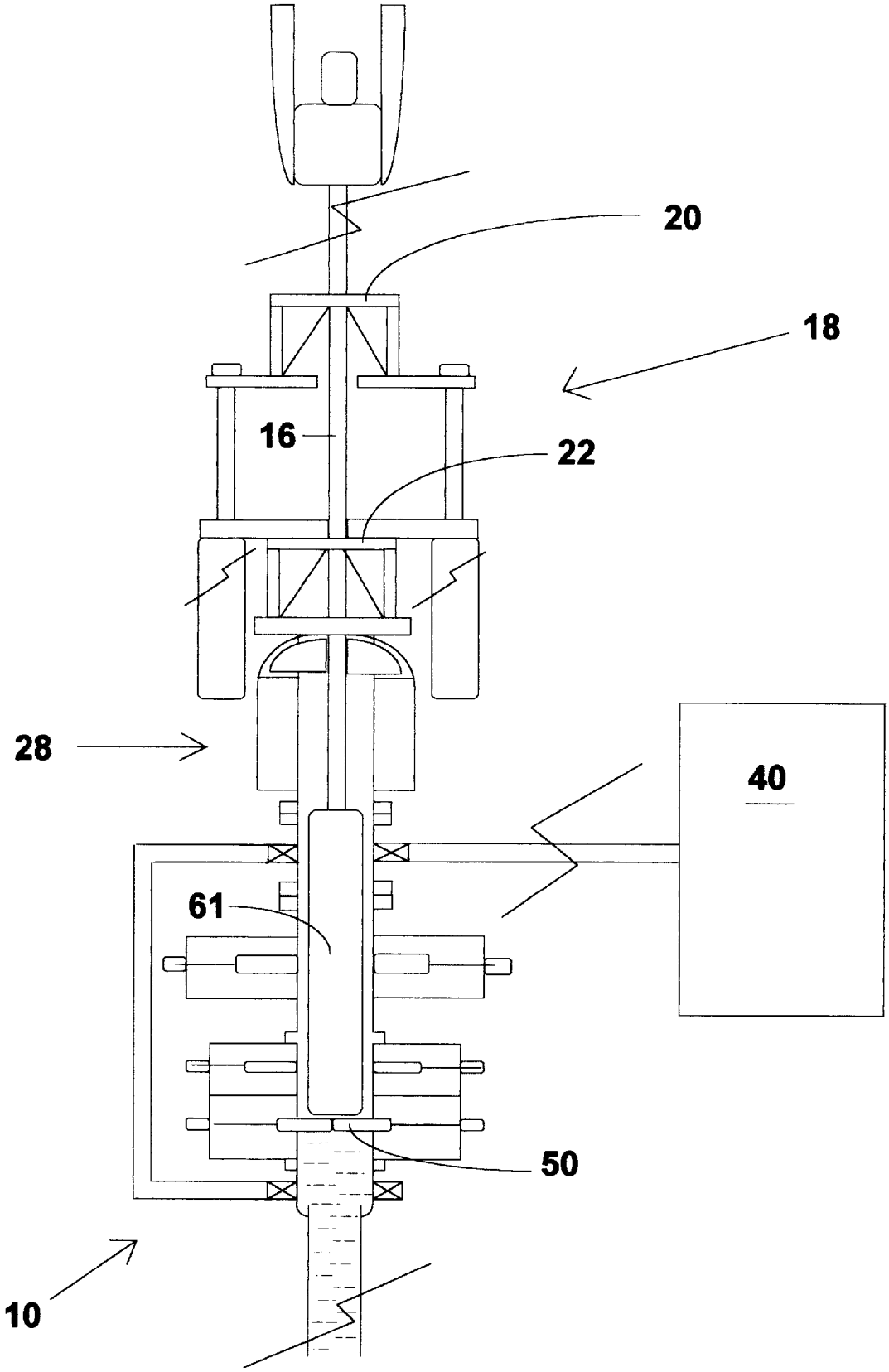

FIG. 2 shows the snubbing configuration 10 with the work floor 11 omitted for simplicity. The Jack 18 is in the raised position with both sets of slips 20 and 22 closed. The pipe 16 and a tool assembly 61 have been lowered mechanically to the top of the blind rams 50. The blind rams 50 are closed and there is well pressure below. The annular BOP 28 is closed and the BOPs are ready to be equalized.

Figure 3:
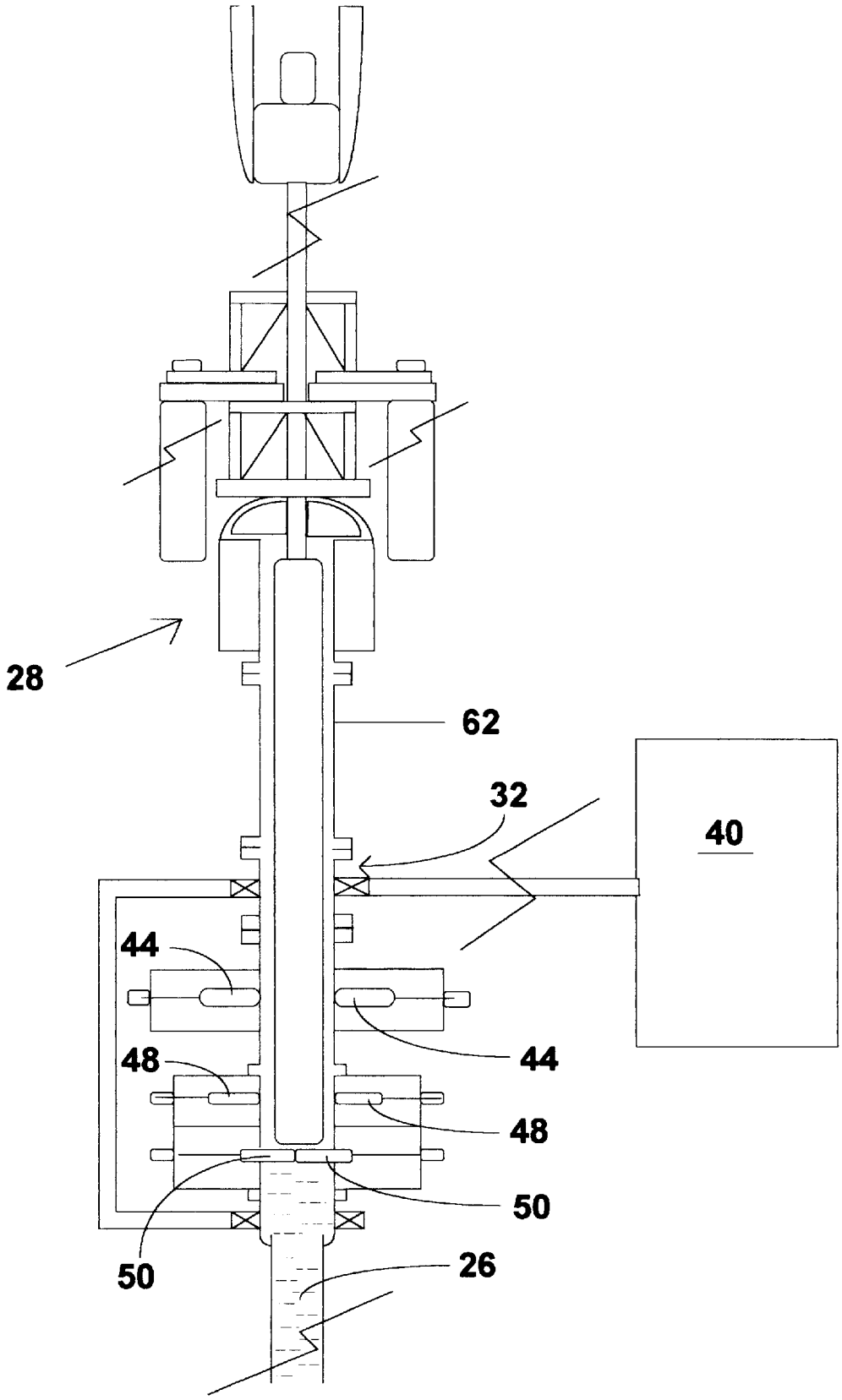
Figure 4:
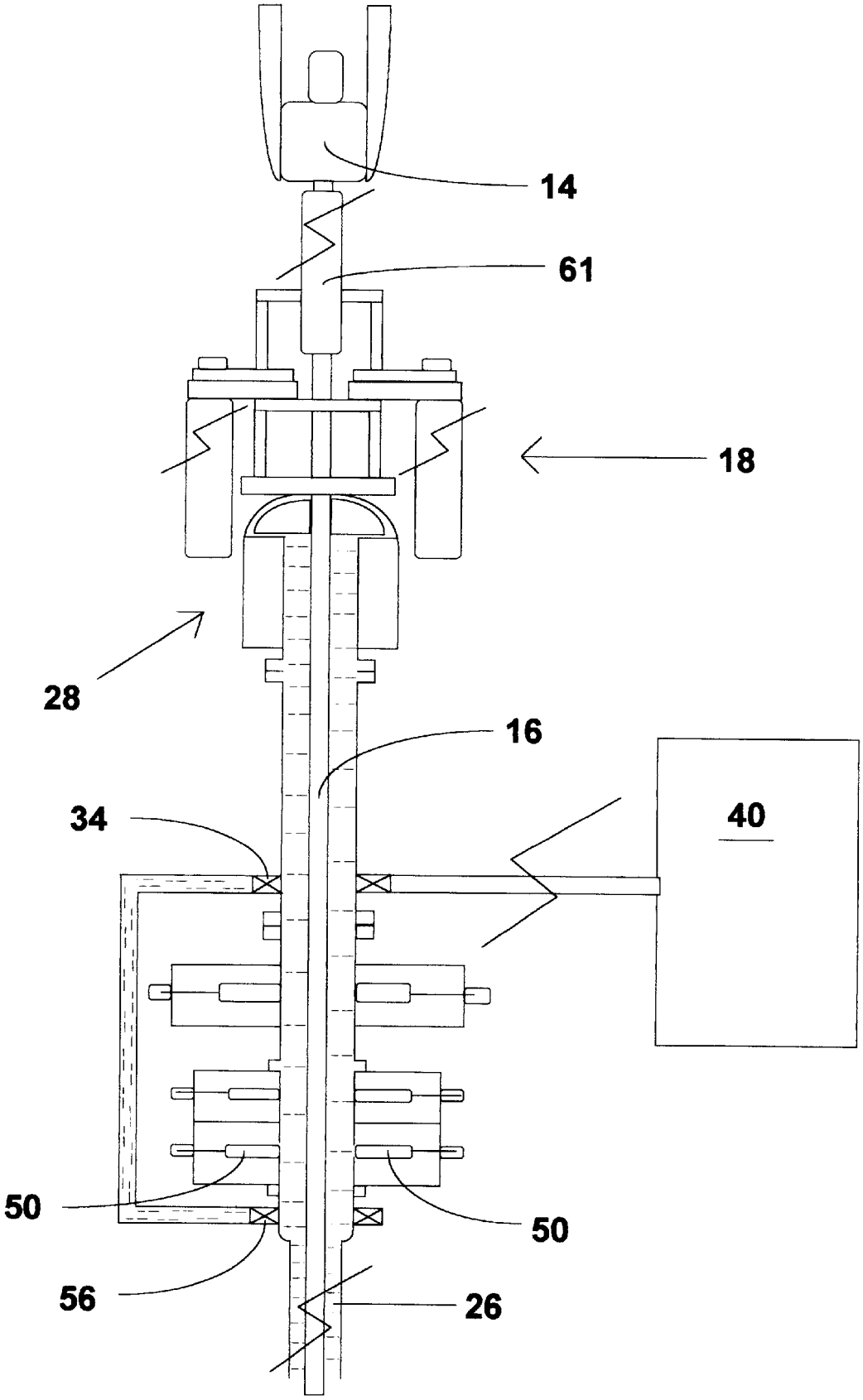

In FIG. 3, an extended lubricating spool 62 has been installed between the annular BOP 28 and the equalizing spool 32. This spool 62 provides adequate space between the stripping rams 44 and the annular BOP 28 for the tool assembly 61 as shown in FIG. 4 to be run into the well bore 26. The pressure is seen below the blind rams 50.

In FIG. 4, the pressure has been equalized through the valves 56 and 34 from the bottom of the blind rams 50 around to the top of the blind rams 50 and is maintained internally by the annular BOP 28. With equal pressure on both sides of the blind rams 50, they can be opened with a static condition throughout the BOP stack. The pipe 16 has been snubbed into the well bore 26 to a point where the tool assembly 61 in the string of pipe is shown above the jack 18 and just below the elevators 14.

Figure 5:
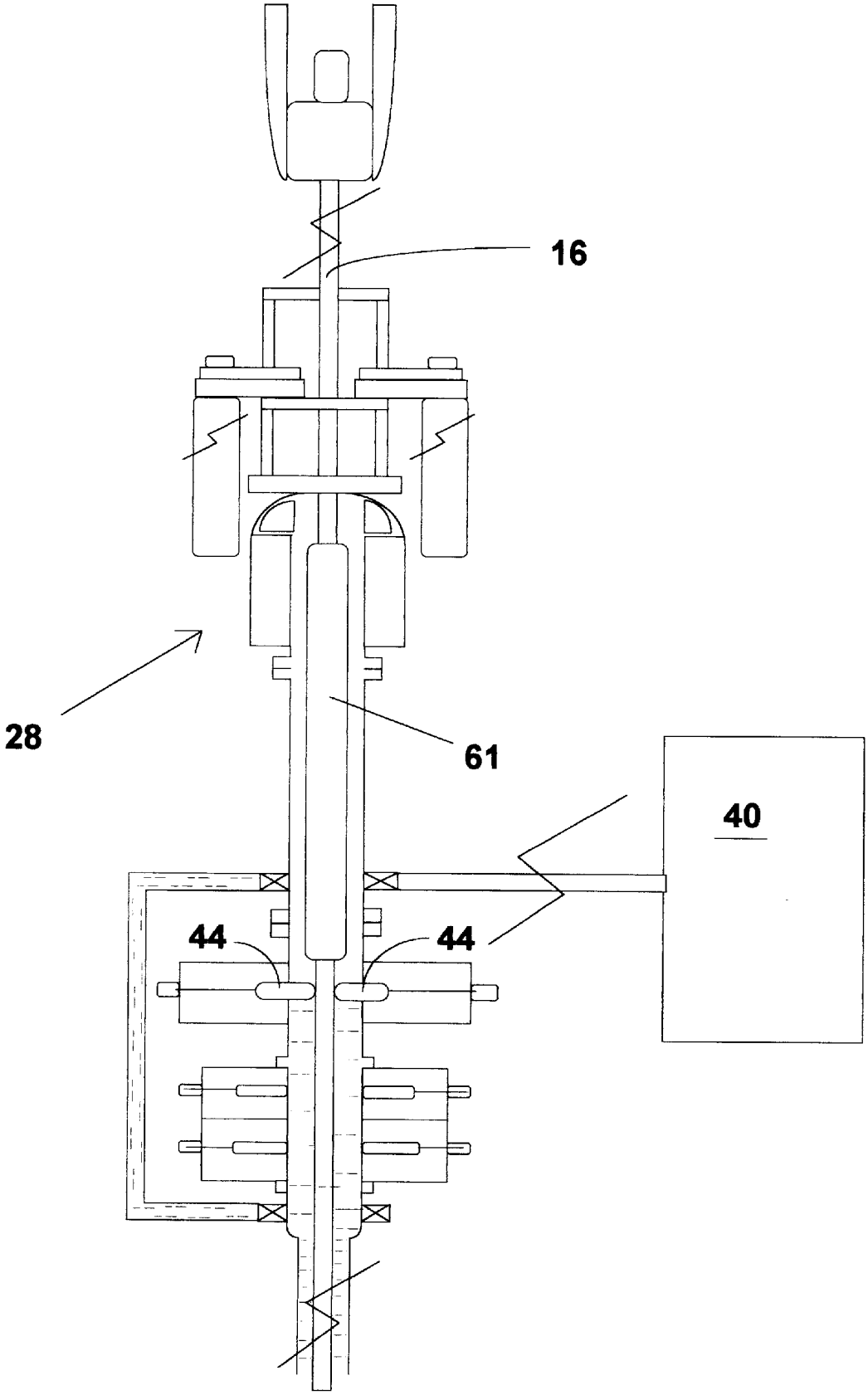

In FIG. 5, the stripping rams 44 have been closed and the pressure bled off above into the tank 40. The annular BOP 28 is then opened and the tool assembly 61 is lowered into the BOP stack. The pipe 16 is lowered mechanically or snubbed into the well bore 26 depending on where the tool assembly 61 is located in the tubing string forming the pipe 16. In this case, we will assume that it is lowered conventionally as it will make no difference to the lubricating procedure.

Figure 6:
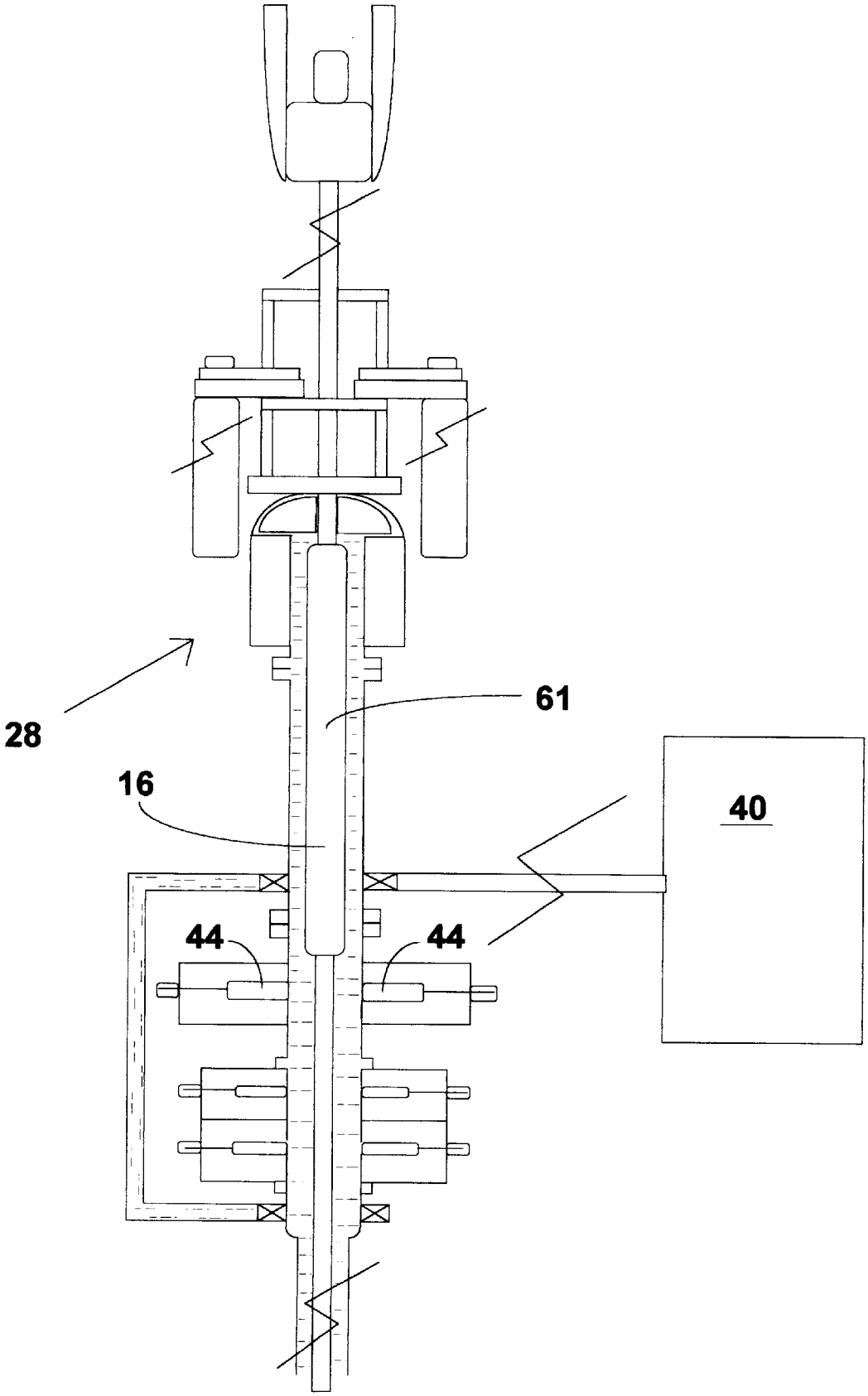

In FIG. 6, the annular BOP 28 is closed and the pressure is equalized between the stripping rams 44 and the annular BOP 28. The stripping rams 44 are then opened and the pipe 16 and tool assembly 61 can now be lowered into the well.

Figure 7:
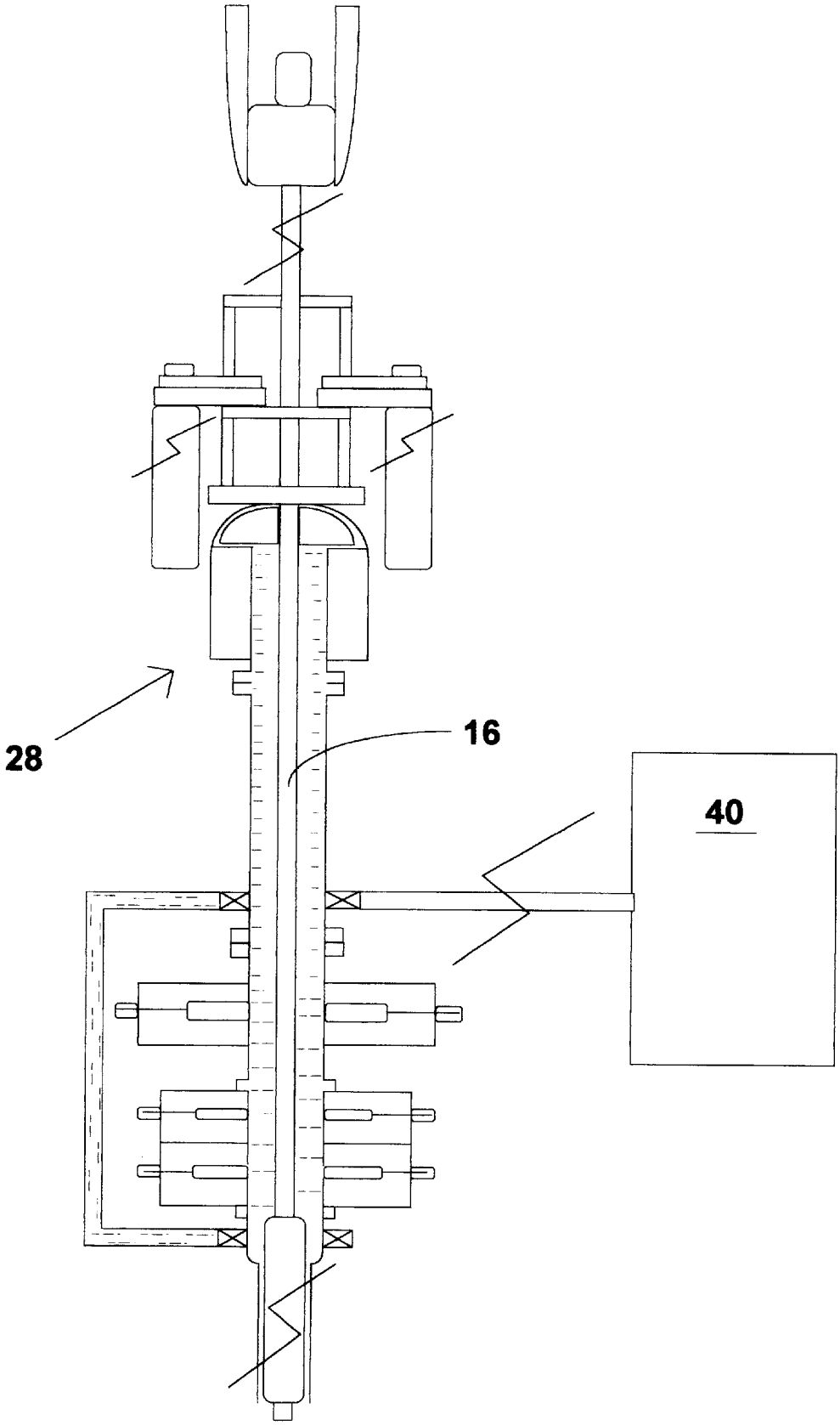

In FIG. 7, the pipe 16 is stripped through the annular BOP 28 to whatever depth in the well bore 26 is desired. A similar lubricating procedure would be used to land the tubing in the well head.

DESCRIPTION OF THE PREFERRED EMBODIMENTS

Figure 8:
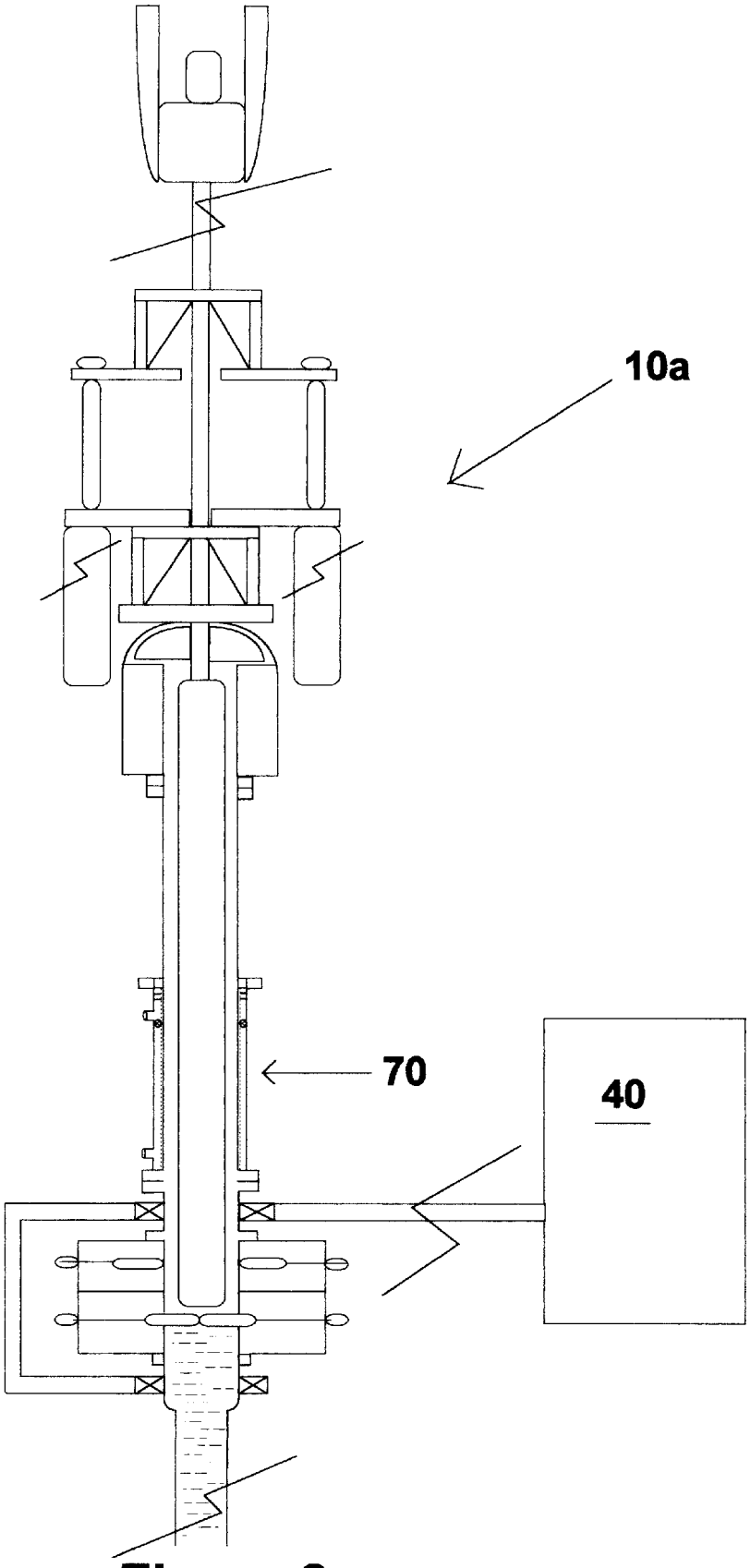
FIGS. 8 through 13 show successive steps in the insertion of a tool assembly into a live well through a snubbing configuration according to a first embodiment of the present invention.

FIG. 8 shows a diagrammatic view of a modification, indicated generally by reference numeral 10*a,* according to the present invention, of the conventional snubbing configuration 10. For convenience, parts of the snubbing configuration 10*a* which correspond to those shown in FIGS. 1 through 7 have been indicated by the same reference numerals. According to the present invention, the modified snubbing configuration 10*a* includes a telescopic housing in the form of a hydraulically telescopically extensible spool, which is indicated generally by reference numeral 70 and which replaces the solid extended lubricating spool 62 and the single gate stripping BOP 42 shown in FIG. 3.

Figure 9:
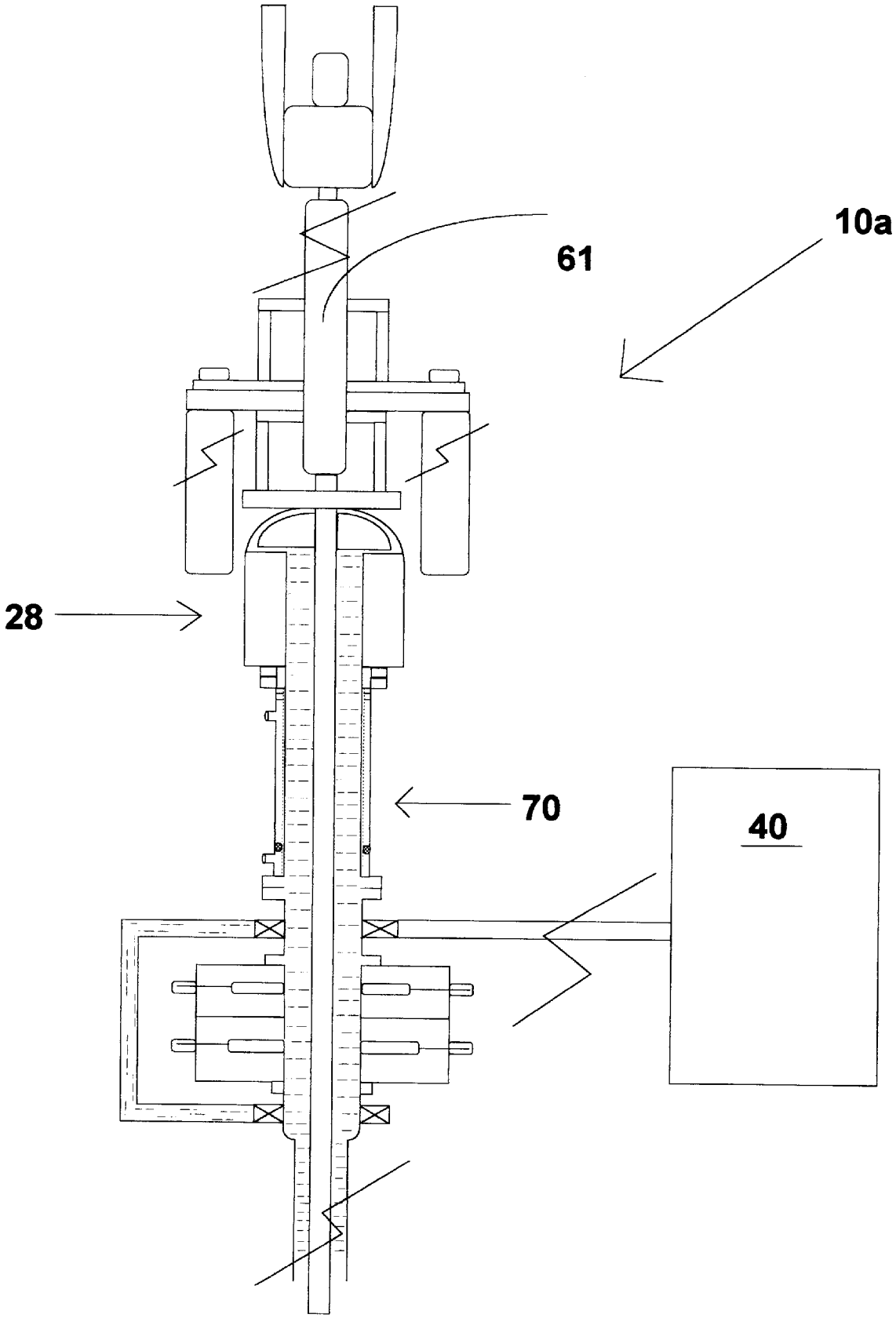

FIG. 9 shows a view corresponding to FIG. 4, with the telescopic spool 70 in a contracted position and with the tools 61 positioned just above the annular BOP 28.

Figure 10:
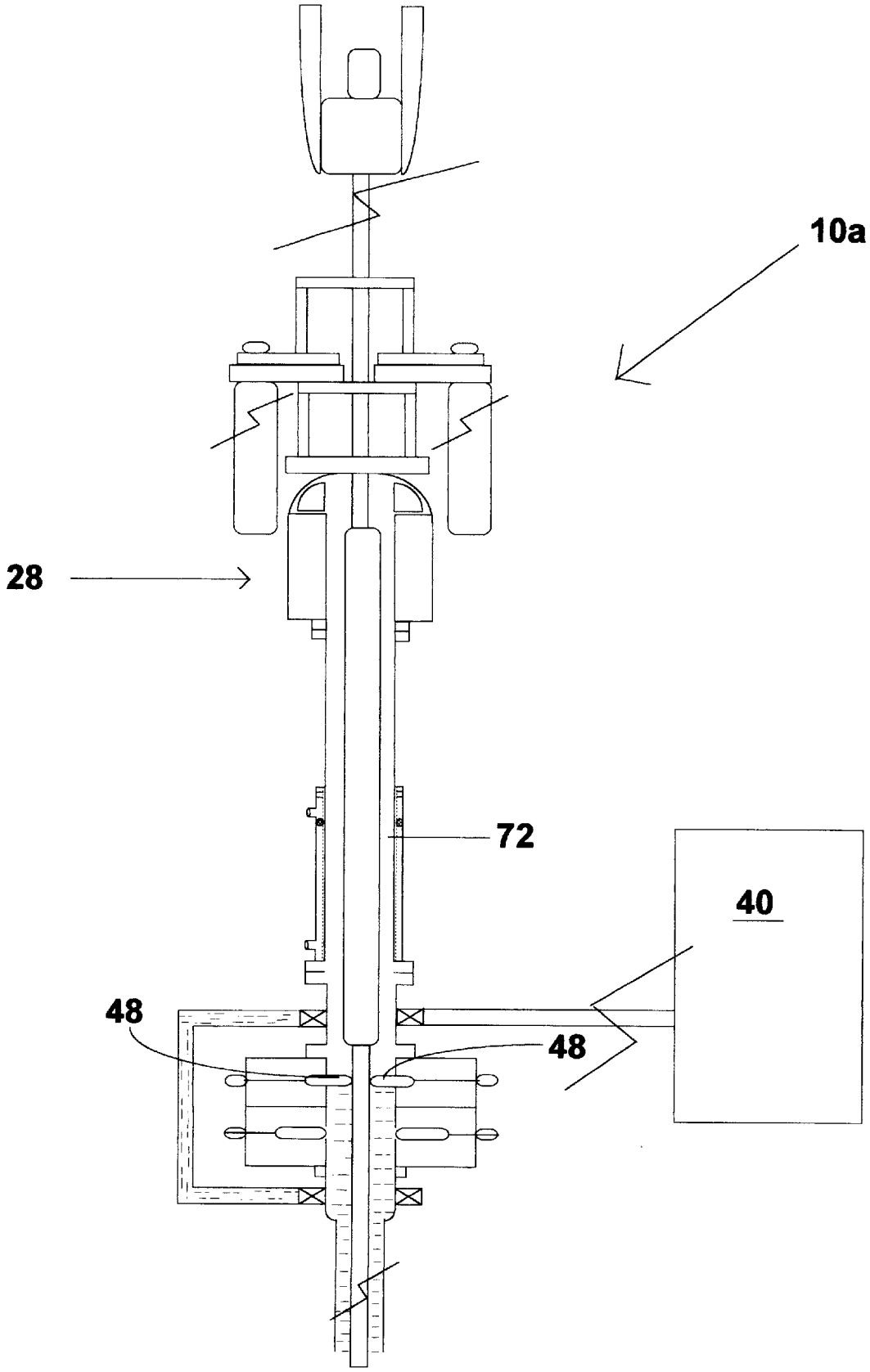

In FIG. 10, the safety pipe rams 48 are closed into sealing engagement with the pipe, and the pressure has been bled offbetween the rams 48 and the annular BOP 28, which has then been opened. The spool 70 is extended upwardly so that the annular BOP 28 is located over top of the tools 61, thus accommodating them inside a lubricating cavity or chamber 72. The tools 61 in this case do not have to be lowered or moved into position while the safety rams 48 closed on the pipe 16 are controlling the pressure.

Figure 11:
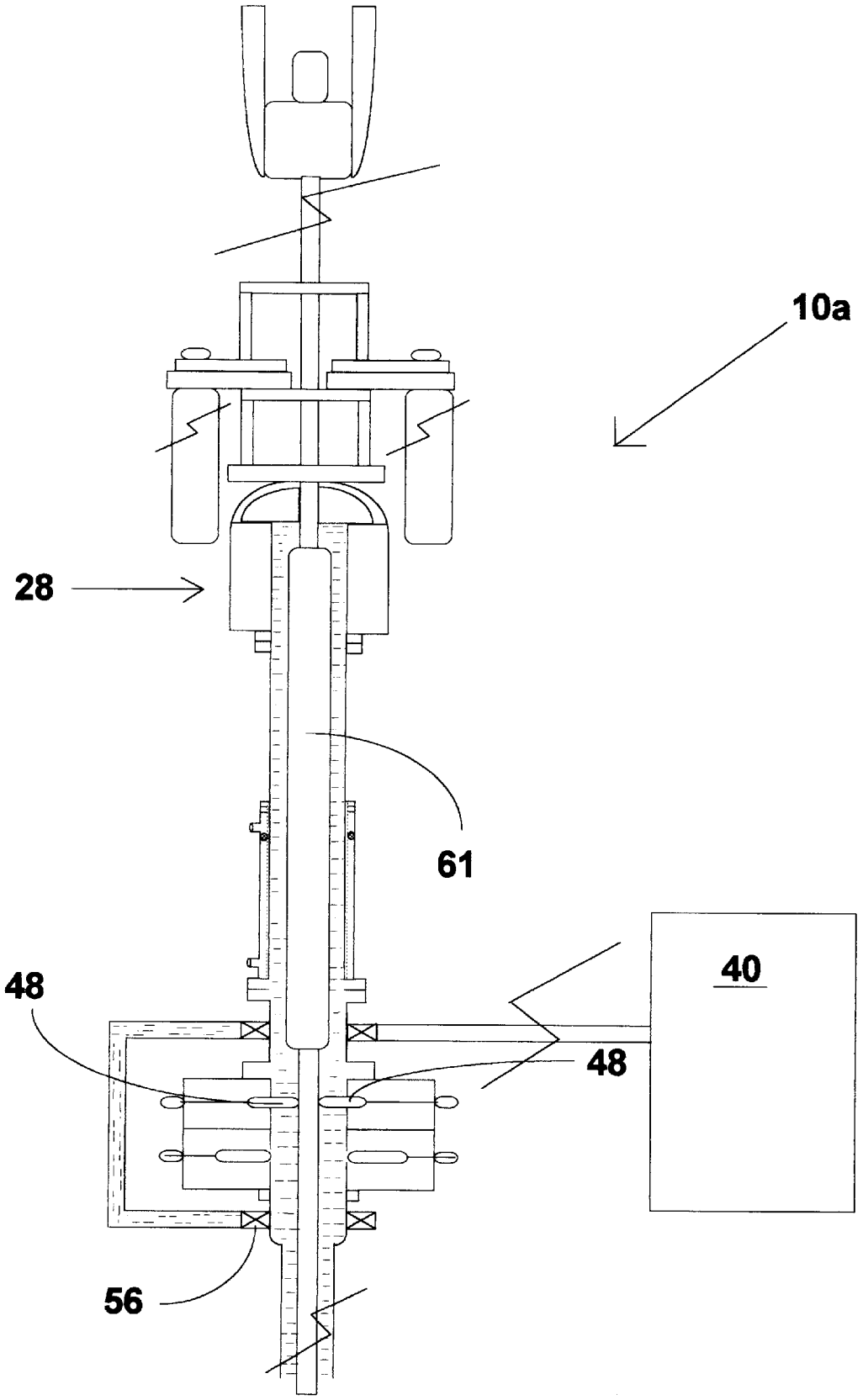
Figure 12:
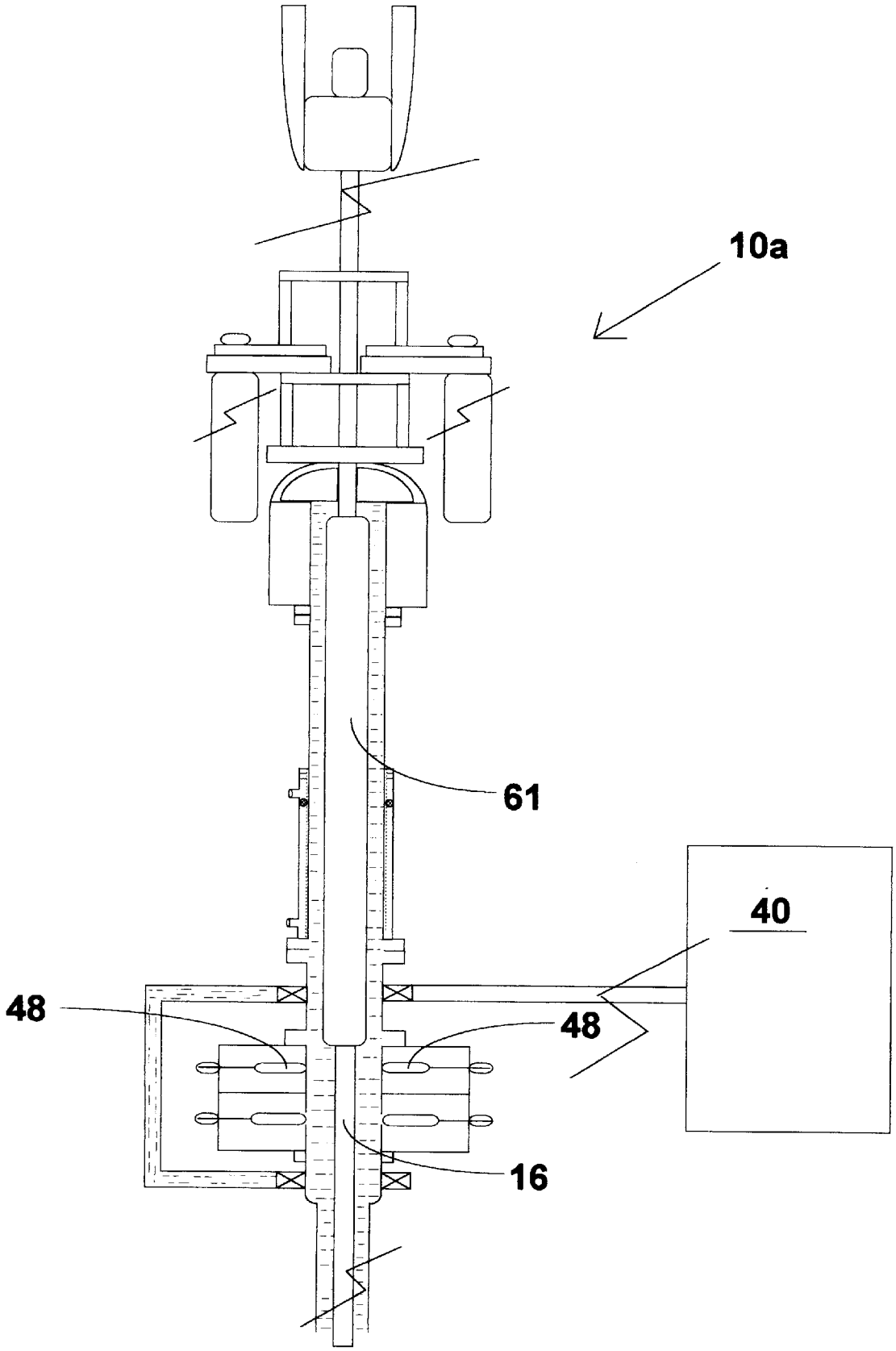

The annular BOP 28 is then closed, as shown in FIG. 11, and the pressure is equalized through the valves 56 and 34 from below the safety rams 48 to the space extending from above the safety rams 48 and below the annular BOP 28. With this pressure equalized, the safety pipe rams 48 are opened (FIG. 12) and the pipe 16 and tools 61 are ready to be lowered into the well bore.

Figure 13:
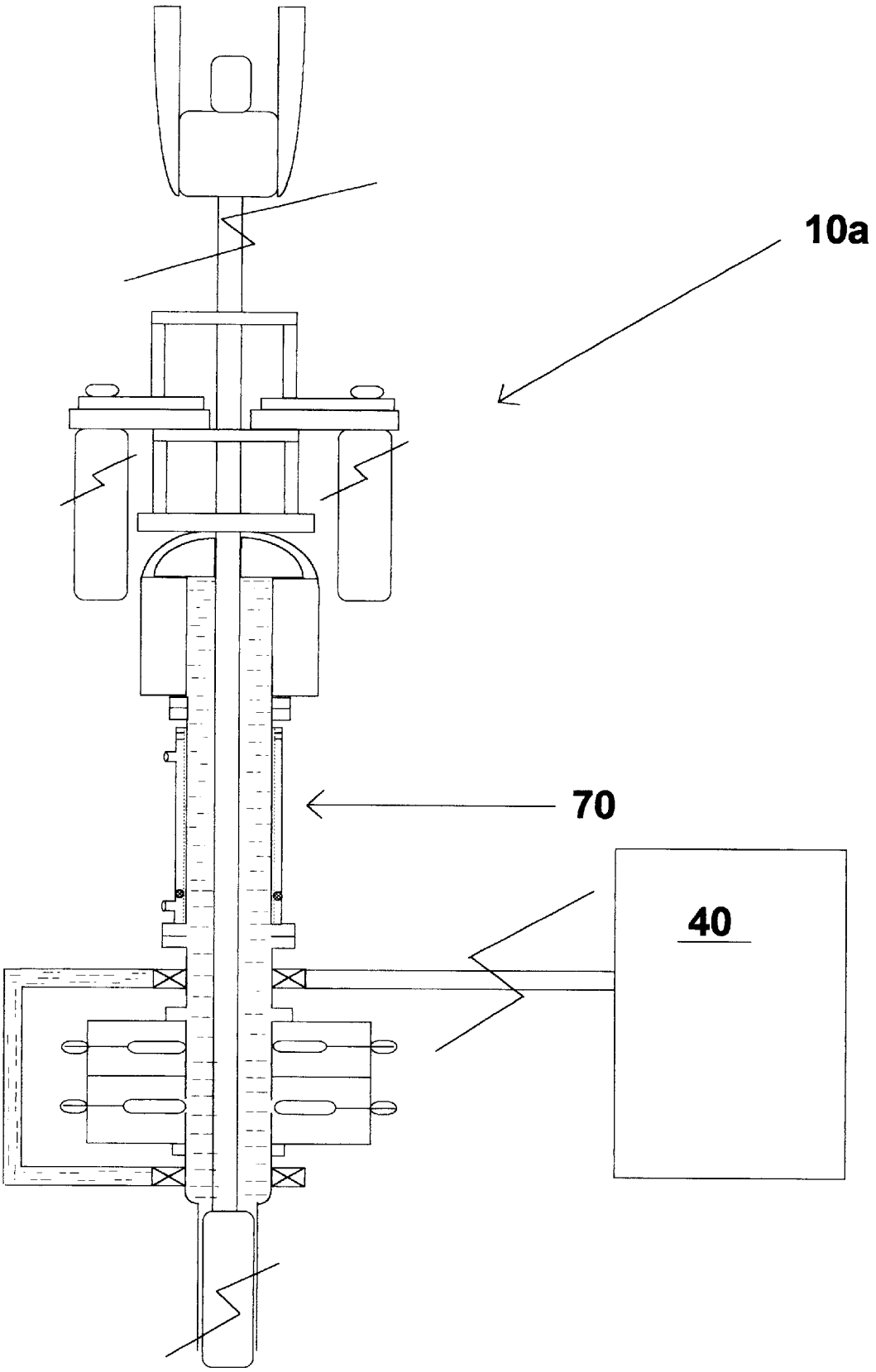

In FIG. 13, the string has been lowered below the surface and the telescopic hydraulic spool 70 is fully lowered or contracted, thus lowering the overall working height to a more desirable level.

FIG. 14 shows a second embodiment of the present invention, which comprises a telescopic hydraulic snubbing jack assembly which is indicated generally by reference numeral 71 and which comprises, from its top down:

a) An upper sealing device in the form of an annular BOP or stripping head 28*a;* b) A flanged or Greylock Hub connection 74;

c) An upper snubbing slip assembly indicated generally by reference numeral 76. The connection 74 connects the annular BOP 28 to the slip assembly 76, which has a through-bore consistent with that of the blowout preventors.

d) A telescopically extendible housing in the form of a hydraulic cylinder or jack 70*a,* which has a nominal through-bore 80 extending its entire length. A standard 7 1/16 bore is considered normal for most well applications, but the bore 80 may range from 4 1/16 to whatever size is warranted for a specific application. The outside diameter is site specific to the piston size needed to power the cylinder. The piston size determines the lift and push forces needed to handle the application which the equipment is intended. The operating hydraulic fluid pressures are also a factor in determining the lift and push capacities of the cylinder.

e) A lower slip assembly indicated generally by reference numeral 85 at the lower end of the cylinder 70*a*. The cylinder 70*a* has flanged or Greylock connecting systems 82 and 84 at opposite ends to connect the slip assembly 76 and the slip assembly 85.

f) An equalizer and bleed-off spool indicated generally by reference numeral 32*a,* provided with flanged or Greylock connecting systems 86 and 88 at opposite ends. The spool 32*a* has ports at opposite sides provided with valves 90 and 92 corresponding to the valves 34 and 36 of FIG. 1.

This configuration should be considered as preferred, although any suitable combination or arrangements of blowout preventors and slips may be used in different embodiment of the present invention.

As shown in FIG. 15, the cylinder 70*a* is connected by hydraulic pressure and return lines 99 and a manifold 96 to an hydraulic pump 98 connected to a tank 95 for containing a supply of hydraulic fluid, the manifold 96 being provided with valves 83 controlling the flow of hydraulic fluid under pressure to and from the cylinder 70*a* and, thus, for extending and retracting the cylinder 70*a*. For convenience, the hydraulic lines 99, the manifold 96, the pump 98, the tank 95 and the valves have been omitted from FIGS. 17 through 26. A similar hydraulic system (not shown) is provided in the embodiments of FIGS. 8 through 13.

The cylinder 70*a,* as will be apparent from the following description, serves both to form an extendible housing, like the cylinder 70 of FIGS. 8 through 13, for receiving a tool assembly 61, and also as an hydraulic jack which serves to raise and lower the annular BOP 28*a* and, thus, which replaces the jacking assembly 18 shown in FIGS. 1 through 13.

FIG. 15 shows the cylinder 70*a* extended, with pipe 16*a* running through the through-bore for the length of the entire assembly.

Figure 17:
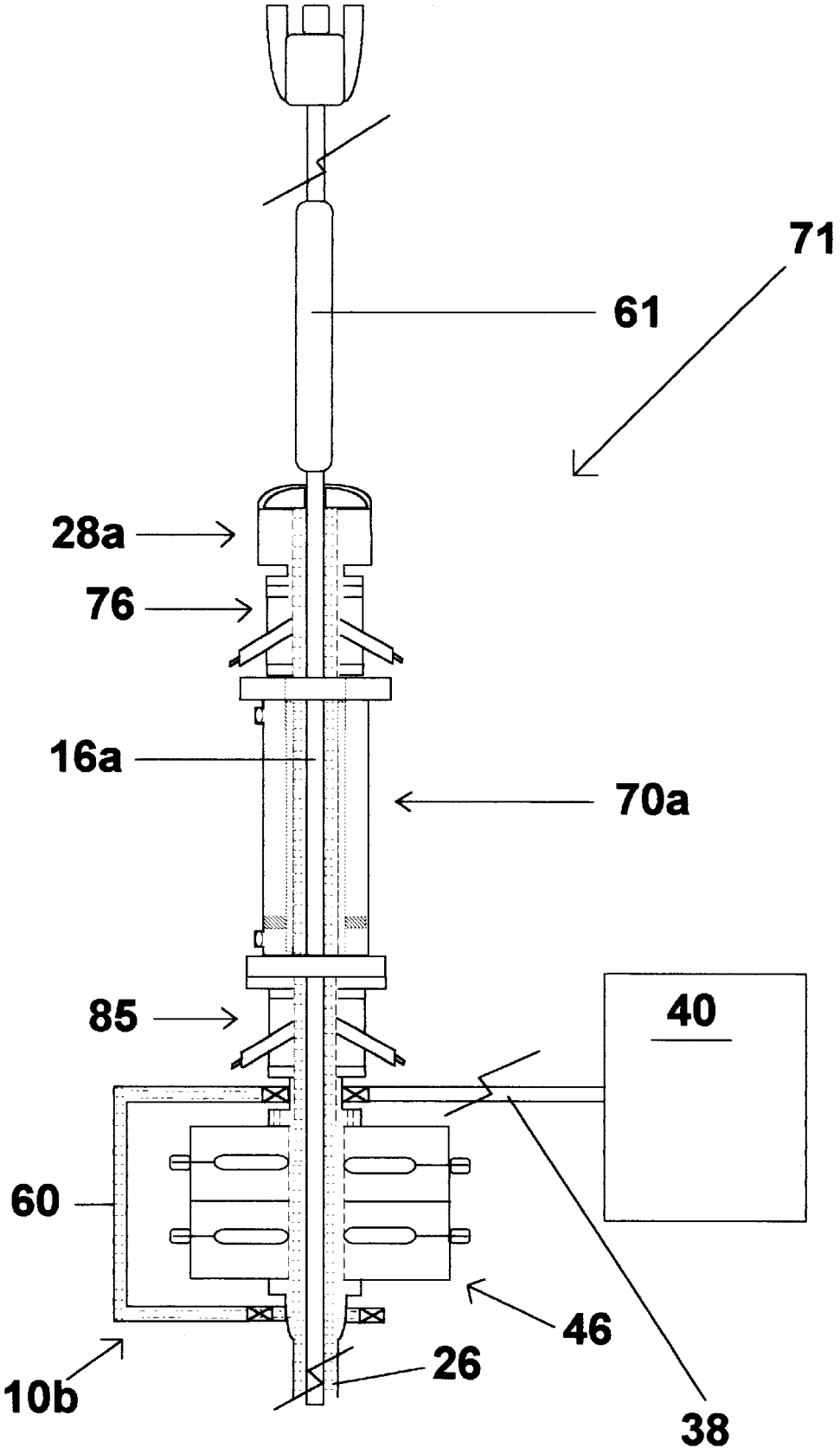

The snubbing slip assembly 76, as shown in FIG. 16, comprises a cylindrical main body 63, much the same as a spool with opposing flanged ends 65 to connect and integrate the slip assembly into the jack assembly 71. The main body 63 has opposed cylindrical projection 67 incorporated into the sides of the main body of the slips that each serve as a chamber to house a piston 69 with rod 69*a*. Any suitable number of these projections 67 may be provided and, in a standard configuration, four projections 67 are provided. However, to facilitate the illustration of the present embodiment of the invention, FIG. 16 shows only two opposed chambers 67. On the inside end of the rod 69*a* a manufactured block or slip body 73 is mechanically attached and designed to receive a slip die. The blocks 73 and dies are replaceable to facilitate different sizes of pipe. The slip dies are engineered with large surface areas and are manufactured with grooves or teeth (not shown) to specifically fit and bite the outer surface area of the tubing being installed into the well. The surface areas of the dies fitted against the pipe are engineered to handle the forces and loads which the pipe 16 will be under in various applications as it is inserted into the well against the pressure acting over the cross-sectional area of the plugged end of the pipe 16 being installed into the well. The hydraulic pressure at which the slip assembly 76 is operated, as well as the sizes of the cylinders 67, the rods 69*a* and the pistons 69, are all correlated with the surface area of the slip dies and the teeth cut into them to perform safely within the scope of the intended application. The cylinders 67 are hydraulically pressurized simultaneously, thus forcing the rods 69*a* to inwardly to a point where the dies make contact with the pipe 16*a,* thus gripping or locking, centering and holding the pipe 16*a* in a stationary position. Ports 75 extending at both sides of the pistons 69 through the walls of the cylinders 67 allow hydraulic fluid to be pumped into cavities on opposite sides of the pistons. The outer ends of the rods 69*a* serve as indicators to show what position the slips are in. If the rods 69*a* are in the slips are closed, and if the rods 69*a* are out the slips are open FIG. 17 shows the jack assembly 71 of FIGS. 14 and 15 installed in a snubbing configuration, indicated generally by reference numeral 10*b,* in place of conventional equipment used in the prior art snubbing configuration of FIGS. 1 to 7. For convenience, parts of the equipment shown in FIG. 17 which correspond to those shown in FIGS. 1 to 7 are indicated by the same reference numerals.

In FIG. 17, the pipe 16*a* has been lowered towards the pressured well bore 26 so as to position the tool assembly 61 just above the upper pipe sealing device, i.e. the annular BOP 28*a,* which is closed in sealing engagement with the pipe 16*a* to maintain well bore pressure below the annular BOP 28*a*.

Figure 18:
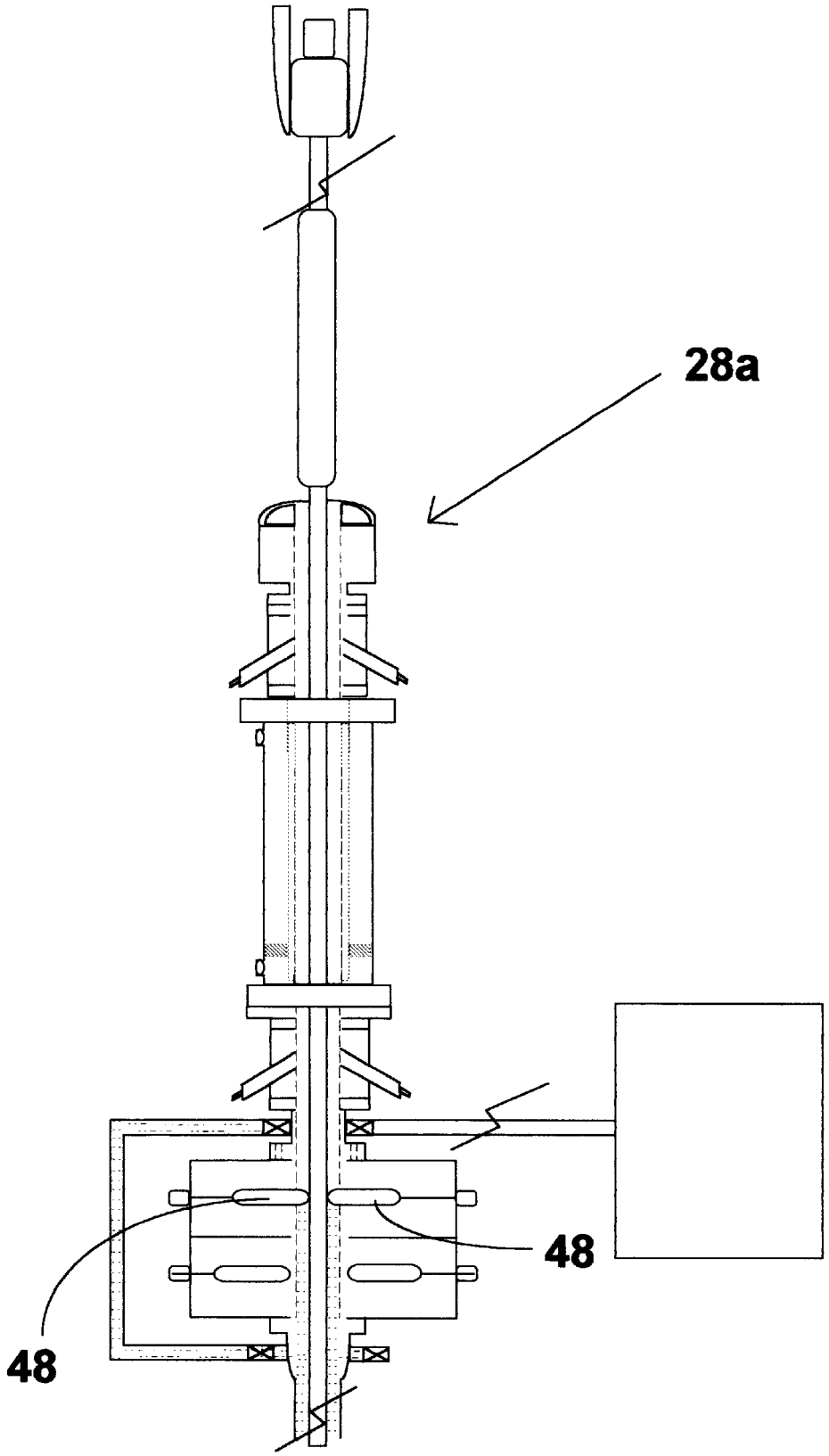

In FIG. 18, the safety pipe rams 48 in the lower pipe sealing device, i.e. the double-gate blowout preventor 46, are then closed into sealing engagement with the pipe 16*a*. The pressure between the pipe rams 48 and the annular BOP 28*a* is then bled off and the annular BOP 28*a* is then opened.

Figure 19:
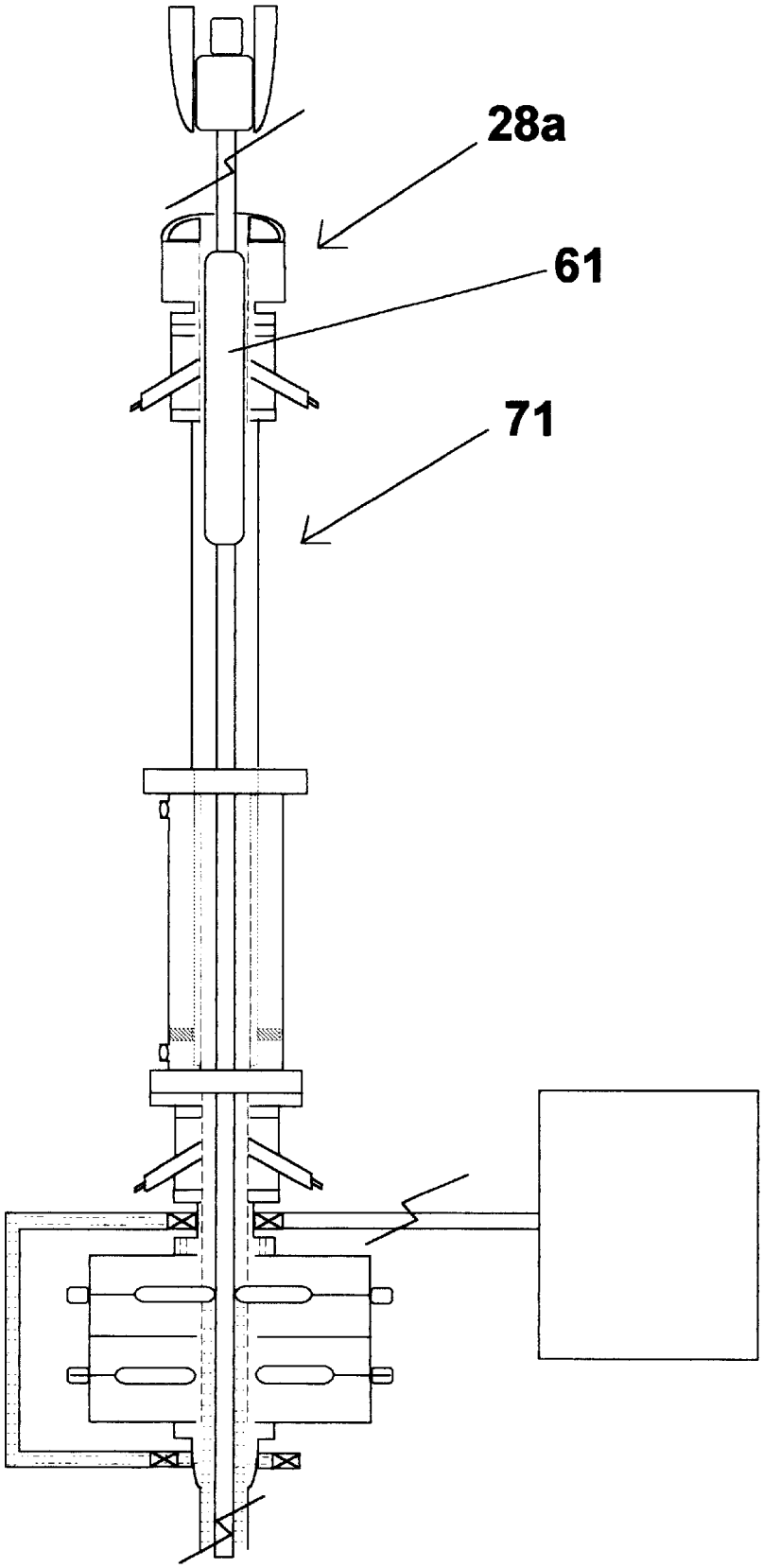
Figure 20:
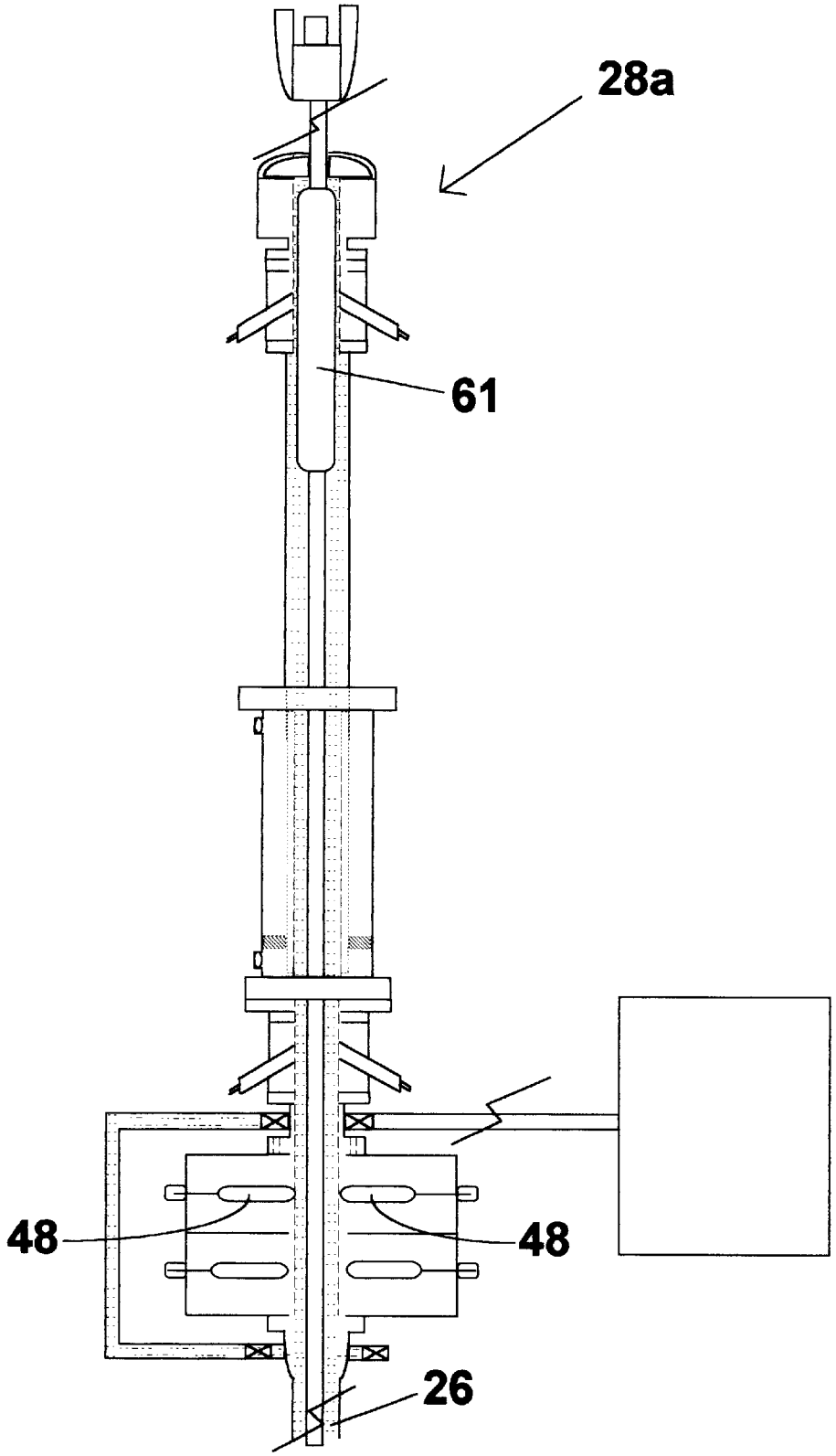

The jack assembly 71 is then telescopically extended to raise the annular BOP 28*a* along the pipe 16*a* to a position above the tools 61, as shown in FIG. 19. Then, the annular BOP 28*a* is closed into sealing engagement with the pipe 16*a,* as shown in FIG. 20, and the pressure between the pipe rams 48 and the annular BOP 28*a* is equalized with the pressure in the well bore. The pipe rams 48 are opened, and the tools 61 are ready to be lowered into the well bore 26.

Figure 21:
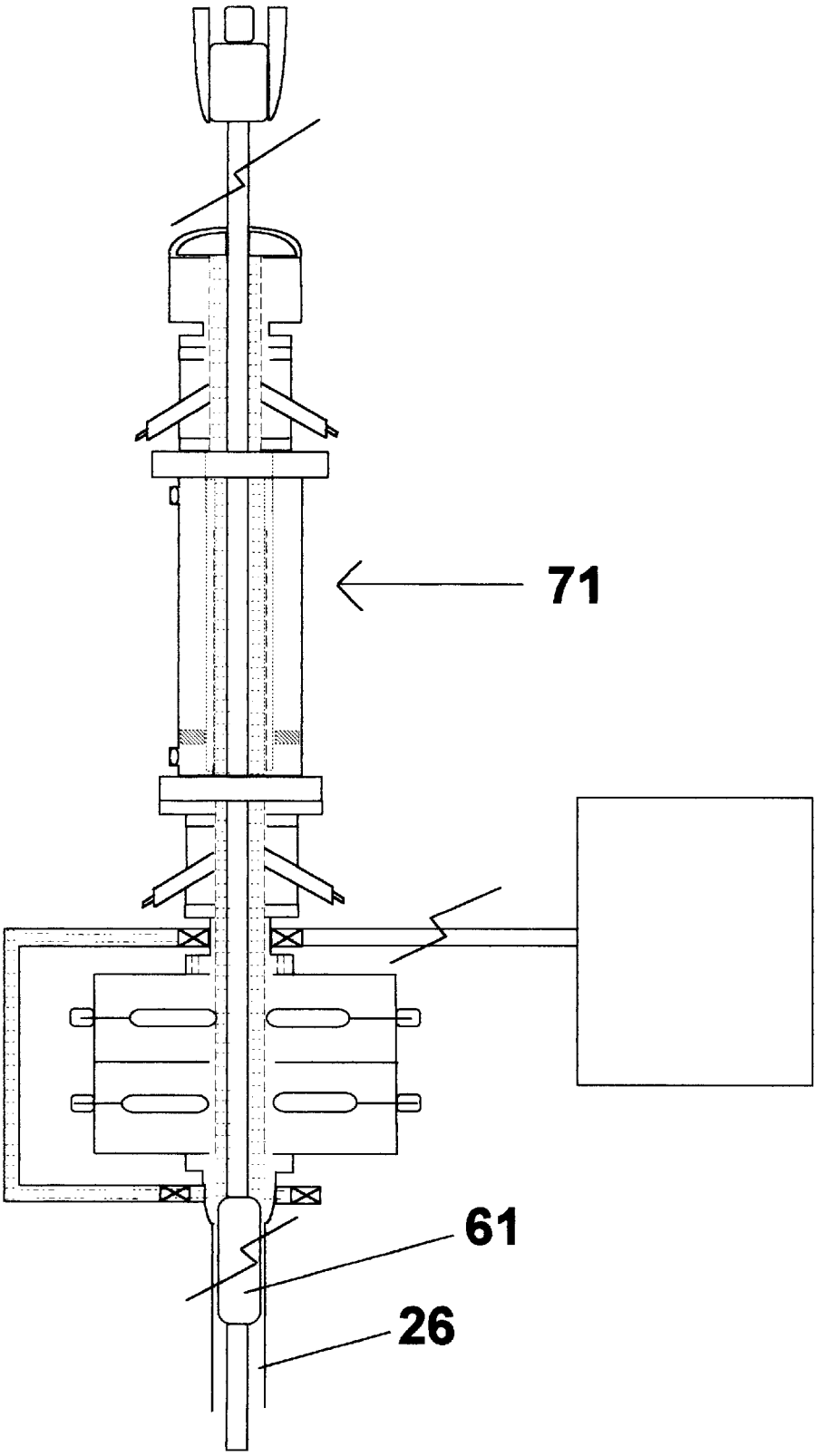

In FIG. 21, the tools 61 are lowered into the well bore 26 and the jack assembly 71 is contracted to its original position, allowing continued operations at desirable working heights and away from the line of fire of the well bore.

Figure 22:
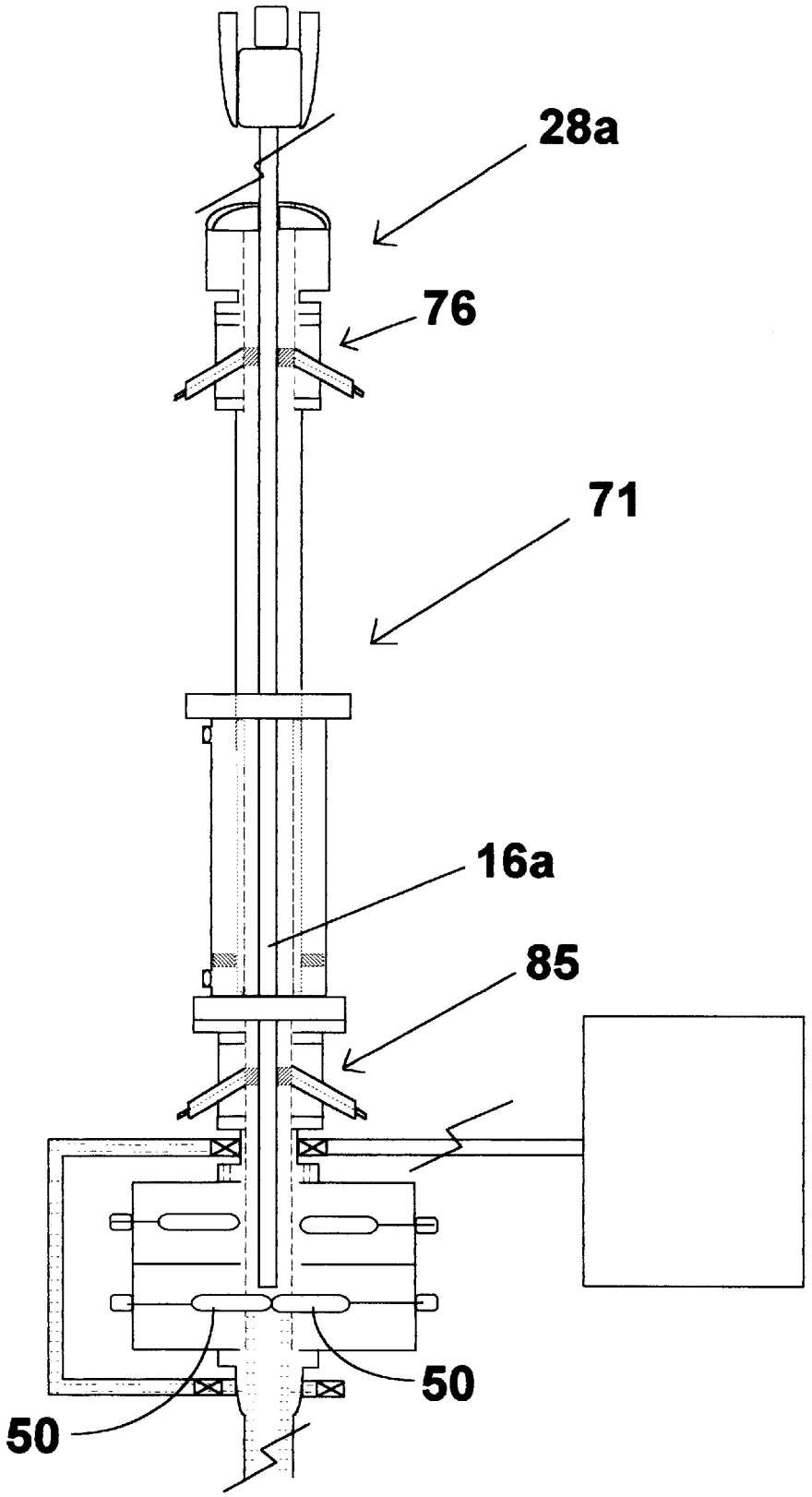

FIG. 22 shows the jack assembly 71 inserting pipe 16*a* (snubbing) while maintaining well pressure. Pressure is below the blind rams 50. The plugged pipe 16*a* is lowered to just above the blind rams 50. The jack 71 is extended and both slip assemblies 76 and 85 are closed on the pipe 16*a* to secure it. The annular BOP 28*a* is closed.

Figure 23:
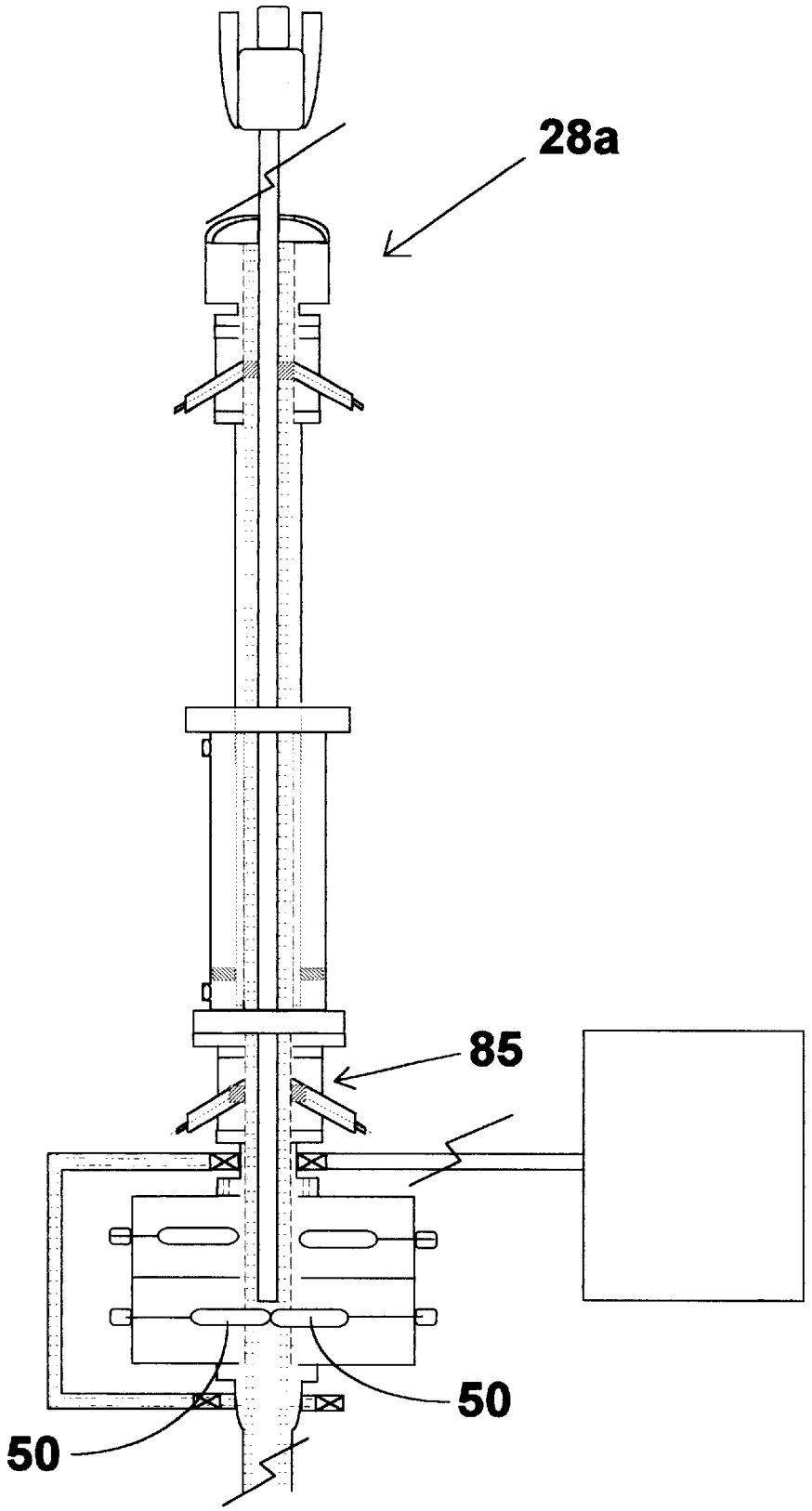
Figure 24:
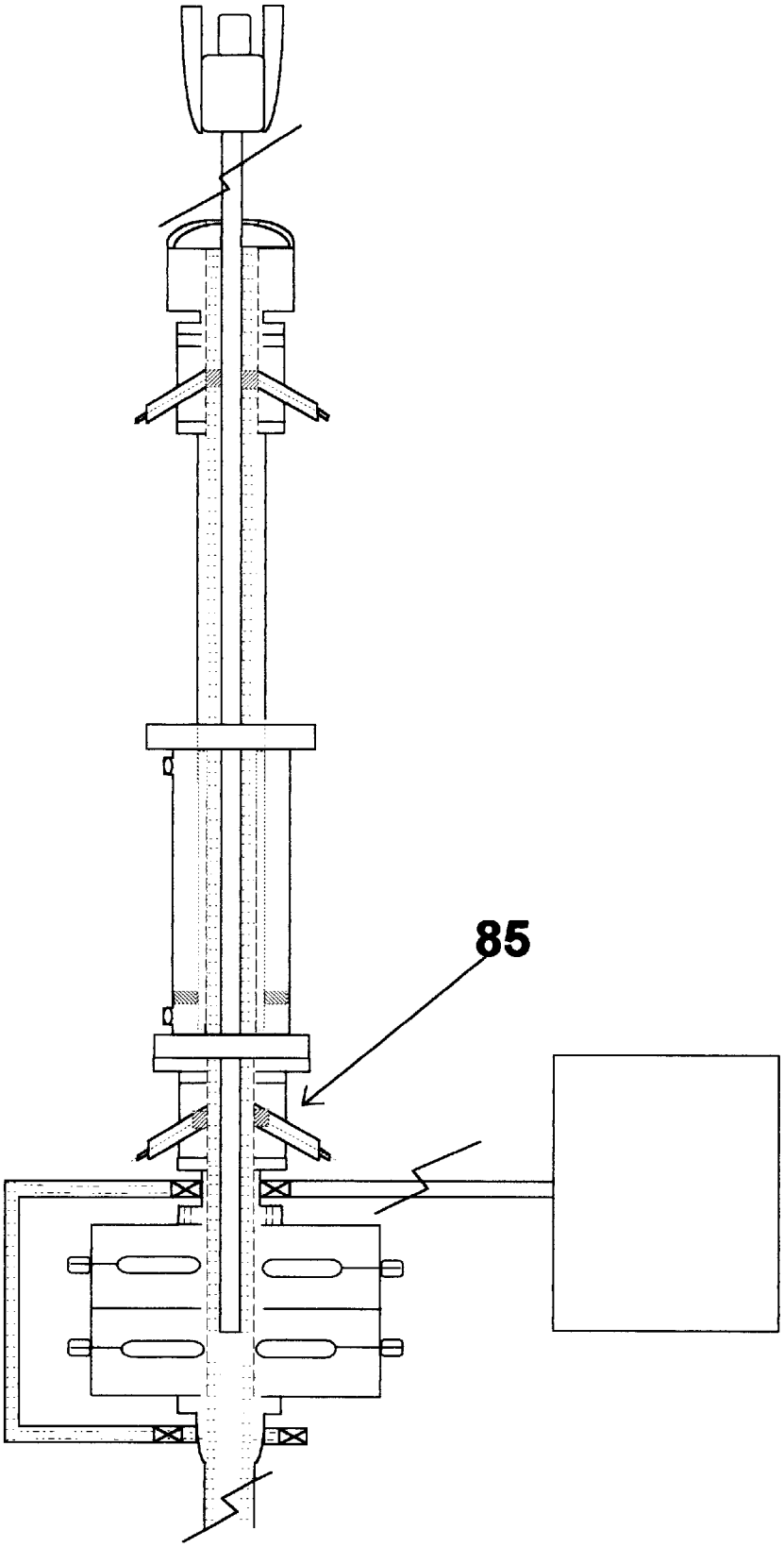
Figure 25:
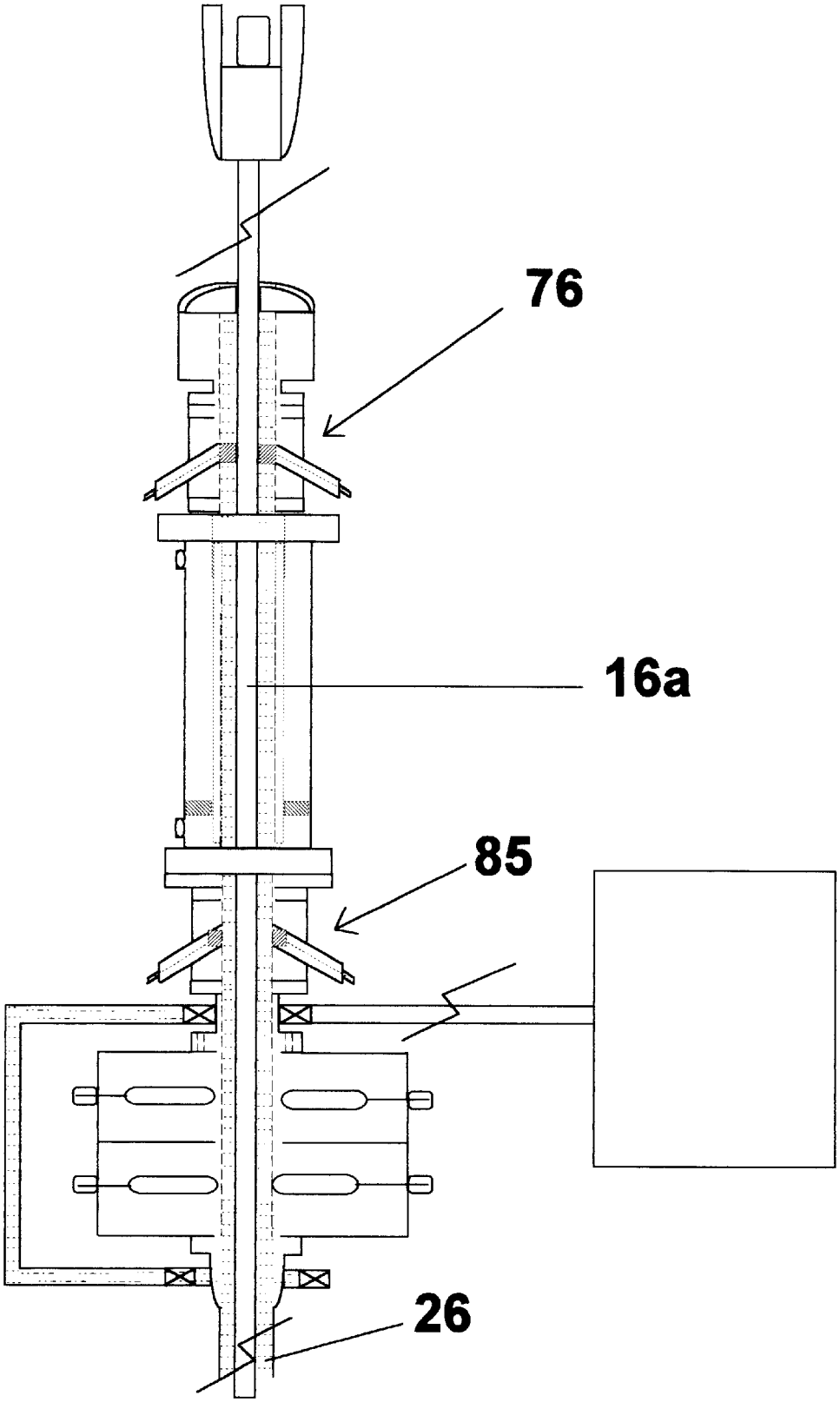

The pressure is then equalized from below the blind rams 50 to the space above the blind rams 50 and below the annular BOP 28*a,* as shown in FIG. 23, and the blind rams 50 are then opened (FIG. 24) and the bottom slip assembly 85 is opened. The pipe 16*a* is ready to snub in the well bore 26 against the forces from the pressure against the cross-sectional area of the pipe 16*a*. Then, as shown in FIG. 25, the jack assembly 71 is contracted, forcing the pipe 16*a* into the bore of the well bore 26.

Figure 26:
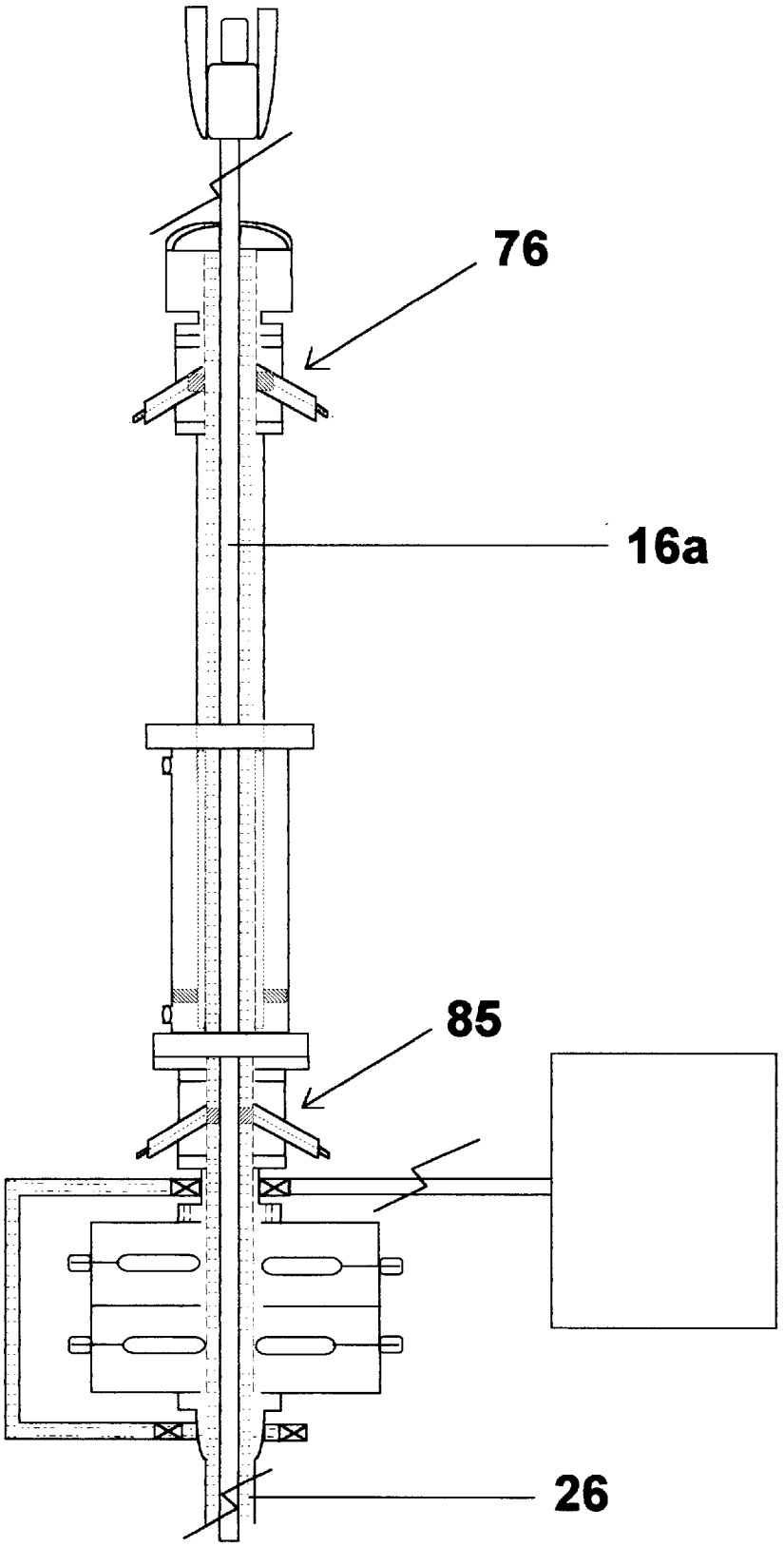
Figure 27:
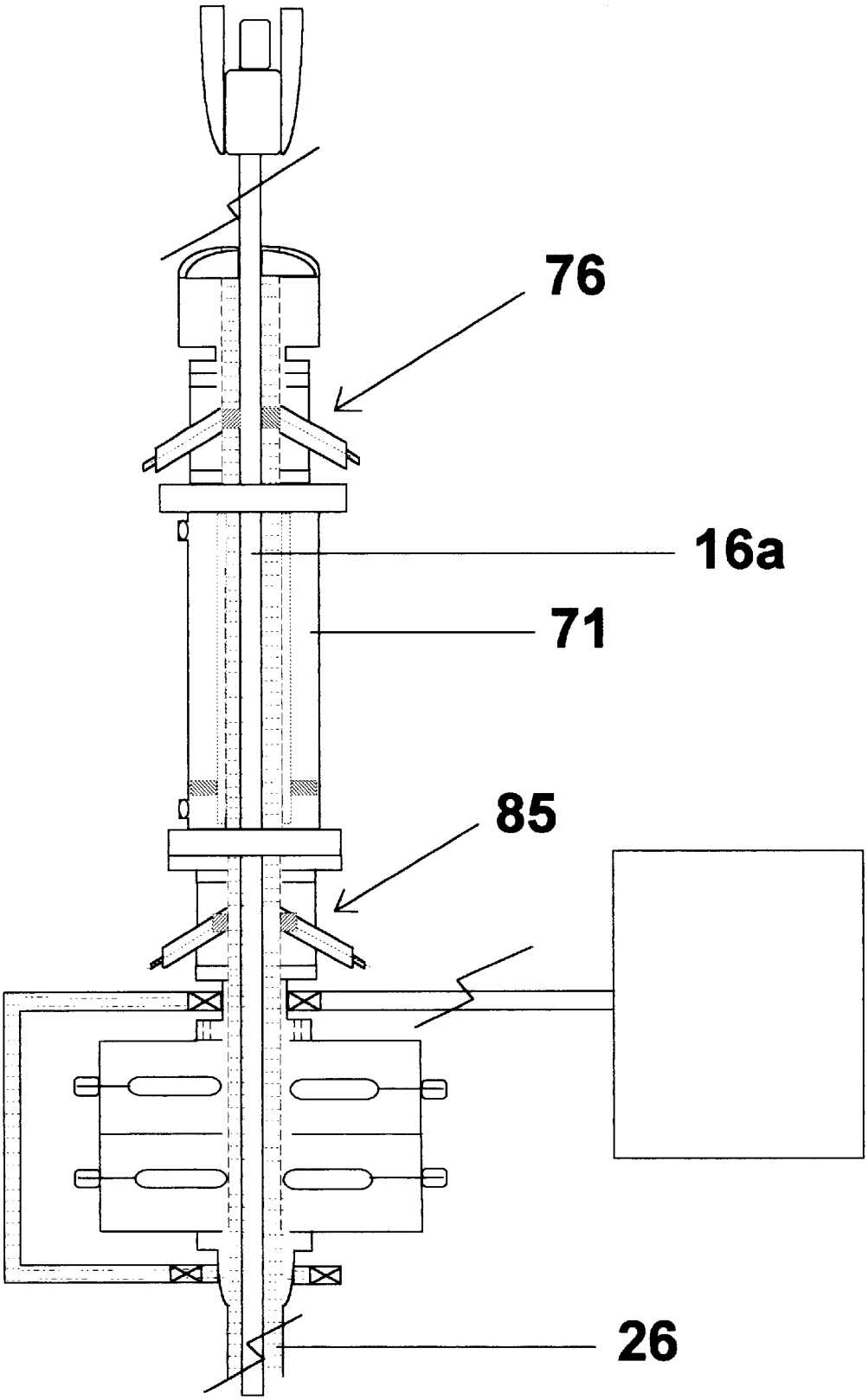

As shown in FIG. 26, the bottom slip assembly 85 is then used to secure the pipe 16*a;* the upper slip assembly 76 is opened; the jack assembly 71 is extended upwardly; the upper slip assembly 76 is closed the lower slip assembly 85 is opened and the jack assembly 71 again is contracted so as to force the pipe 16*a* down the well bore 26.

These steps are repeated until the pipe 16*a* reaches a pipe-heavy position. When each stroke of the jack assembly 71 is taken upwardly, the annular BOP 28*a* maintains well pressure while it slides up the surface of the pipe 16*a*. During conventional snubbing operations, the pipe 16*a* is forced into the annular BOP 28, which is located below the actual jack assembly, as illustrated in FIGS. 1 and 2, and all operations are performed while standing over the well bore. This method according to the present invention is therefore much more desirable from a safety standpoint as the line of fire from the well pressure is moved up and away from working personnel and all operations are effected from a remote location away from the well bore.

As will be apparent to those skilled in the art, modifications may be made in the above embodiments of the invention and the method of operation thereof within the scope of the invention as defined in the appended claims.

For example, the equalizer and bleed-off spool 32*a* shown in FIG. 14 as being connected to the lower snubbing slips 86, could be replaced by an equalizer incorporated in the hydraulic telescopic jack 70*a* by extending the latter downwardly sufficiently to enable the appropriate ports to be provided in the telescopic jack.

Also, while the above-described embodiments of the invention employ an annular BOP as the upper blowout preventor, it is alternatively possible to use a hydraulic or mechanical stripping head as the upper sealing device. An annular BOPs is desirable in most low to medium pressure applications for stripping the tubing through as this type of blowout preventor allows the passage of couplings and other slightly non-conforming items in the string without any delay or extra steps. A coupling, for example, simply enters the top of a pliable element in the BOP which is typically of a soft enough composition that it gives away to the coupling. A combination of the memory within the composition of the element and the constant hydraulic pressure activating the BOP, in addition to the well pressure compressing the element, allow passage of the coupling without losing control of the pressure or slowing up the installation procedure.

In higher-pressure applications, a stripping ram type BOP may replace the annular BOP. Ram type preventors generally allow the nominal portion of the pipe to be moved within the rams that are closed on the pipe at considerably higher pressures then annular BOPs. Such rams have a steel body cut out to conform to the nominal size of the pipe, with a thin rubber face. When the opposing rams come together around the pipe, they essentially are two steel bodies with a highly compressed thin center sealing off the pressure. The tolerance of the rubber between the two opposing rams is very slight, thus allowing maintenance of higher pressures.

An annular BOP element is mostly comprised of rubber. When the pliable element is compressed around the pipe, there is considerable tolerance in the 2–3 inches of rubber closed around the pipe. Because of the amount and area of rubber around the pipe and the fact that it is pliable, the possibility exists that the rubber could be blown out of the BOP, causing temporary loss of control of the pressure on the well.

In a high pressure application, with a ram type stripping BOP replacing an annular BOP, the pipe would be stripped through the rams to a point just above the coupling (where the next pipe is connected to the previous one), then the safety rams in the double-gate BOP are closed, the pressure is bleed off between the two BOPs, the top stripping rams are opened and the telescopic spool is extended up over the top of the coupling. The stripping ram is then closed, the pressure equalized and the safety rams are then opened. The pipe is then lowered into the well to the next coupling and the same procedure is be repeated until all the pipe and/or tools are in the well. This is a slow process, but is considered much safer in high-pressure application.

Thus, the present invention may employ a ram-type stripping BOP and or other annular, spherical or any type of BOP or stripping device designed to move pipe through its sealing surface or element while maintaining well pressure.

Also, the telescopically extendible housing may be mechanically extendible, instead of hydraulically extendible and the snubbing slips may be replaced by any other suitable pipe gripping devices.

I claim:

1. A method of inserting a pipe into a live well bore through upper and lower sealing devices at upper and lower ends of a vertically telescopically extensible and retractable housing, said method comprising the steps of:

a) maintaining pressure in said well bore by closure of said lower sealing device;

b) feeding said pipe downwardly towards said well bore;

c) telescopically extending said housing vertically along said pipe and raising said upper sealing device along said pipe;

d) closing said upper sealing device into sealing engagement with said pipe;

e) equalizing pressure in said housing with the pressure in said well bore;

f) opening said lower sealing device; and g) vertically contracting said housing and lowering said pipe past said lower sealing device.

2. The method as claimed in claim 1, which includes bleeding-off pressure from said housing with said upper sealing device closed and opening said upper sealing device prior to the step of vertically telescopically extending said housing.

3. The method as claimed in claim 1, which includes raising said upper sealing device past tools on said pipe in said housing by the step of vertically telescopically extending said housing.

4. The method as claimed in claim 1, in which the step of raising said upper sealing device is effected by jacking said upper sealing device by a jacking assembly separate from said housing.

5. The method as claimed in claim 1, in which the step of raising said upper sealing device comprises jacking said upper sealing device by the telescopic extension of said housing.

6. The method as claimed in claim 1, in which the step of feeding said pipe downwardly towards said well bore comprises lowering tools on a lower end of said pipe into said hosuing.

7. The method as claimed in claim 1, in which the step of feeding said pipe downwardly towards said well bore includes lowering a portion of said pipe through said lower sealing device thereby lowering, towards said housing, tools which are provided on said pipe above said portion.

8. The method as claimed in claim 7, which includes lowering said tools to a position above said upper sealing device, with said upper sealing device closed into sealing engagement with said pipe beneath said tools, bleeding-off pressure from said housing, and opening said upper sealing device before the step of vertically telescopically extending said housing and which includes raising said upper sealing device past said tools upon the telescopic extension of said housing.

9. A method of inserting tools attached to a pipe into a live well bore through upper and lower sealing devices provided at upper and lower ends of a housing, comprising the steps of:

a) lowering said pipe to position said tools above said upper sealing device;

b) said upper sealing device being closed into sealing engagement with said pipe below said tools to maintain pressure in said well bore;

c) closing said lower sealing device into sealing engagement with said pipe;

d) bleeding-off pressure from between said upper and lower sealing devices;

e) opening said upper sealing device;

f) raising said upper sealing device along said pipe to a position above said tools and telescopically extending said housing;

g) closing said upper sealing device into sealing engagement with said pipe;

h) equalizing pressure between said upper and lower sealing devices with the pressure in said well bore;

j) opening said lower sealing device; and k) telescopically contracting said housing and lowering said tools past said lower sealing device into said well bore.

10. The method as claimed in claim 9, in which step f) comprises employing hydraulic telescopic extension of said housing to force said upper sealing device upwardly past said tools.

11. A method of inserting a pipe into a live well bore through a housing located between upper and lower sealing devices, comprising the steps of:

a) maintaining pressure in said well bore by closure of said lower sealing device;

b) telescopically extending said housing along said pipe and thereby raising said upper sealing device and an upper pipe gripping device along said pipe;

c) closing said upper sealing device into sealing engagement with said pipe;

d) closing said upper pipe gripping device into gripping engagement with said pipe above said housing;

e) equalizing pressure between said upper and lower sealing devices with the pressure in said well bore;

f) opening said lower sealing device;

g) hydraulically telescopically contracting said chamber to thereby displace said upper sealing device, said upper pipe gripping device and said pipe downwardly and to force said pipe downwardly past said lower sealing device towards said well bore;

h) closing a lower pipe gripping device beneath said housing into gripping engagement with said pipe;

i) opening said upper pipe gripping device to release said upper pipe gripping device from gripping engagement with said pipe;

j) telescopically extending said housing and raising said upper sealing device and said upper pipe gripping device along said pipe while said upper sealing device maintains the pressure of said well bore below said upper sealing device;

k) closing said upper pipe gripping device into gripping engagement with said pipe;

l) opening said lower pipe gripping device to release said lower pipe gripping device from gripping engagement with said pipe; and m) repeating steps g) through l).

12. A method of inserting a pipe into a live well bore, comprising the steps of:

lowering a lower end of said pipe through a telescopically extendible housing to a lower sealing device which maintains pressure in said well bore by closure of said lower sealing device;

telescopically extending said housing along said pipe;

closing an upper sealing device above said pipe into sealing engagement with said pipe;

equalizing pressure between said upper and lower sealing devices with pressure in said well bore;

opening said lower sealing device; and telescopically contracting said housing to thereby force said lower end of said pipe downwardly past said lower sealing device.

13. The method as claimed in claim 12, which includes repeatedly telescopically extending and contracting said chamber to lower said pipe further into said well bore.

14. The method as claimed in claim 12, which includes gripping said pipe above said chamber and releasing gripping of said pipe below said chamber after the telescopic extension and prior to the subsequent telescopic contraction of said chamber.

15. Apparatus for inserting a tool assembly on a pipe into a live well bore, comprising:

upper and lower pipe sealing devices;

upper and lower pipe gripping devices;

a vertically telescopically extensible and retractable housing between said upper and lower sealing devices, said telescopic housing being vertically telescopically extendible;

said housing defining a chamber for receiving the tool assembly; and a pressure equalizing duct interconnecting said chamber and the well bore;

said pressure equalizing duct being provided with a shut-off valve.

16. The apparatus as claimed in claim 15, wherein said upper sealing device is mounted on said telescopic housing so as to be vertically displaceable by vertical extension and retraction of said telescopic housing.

17. The apparatus as claimed in claim 16, wherein said housing comprises a telescopic jack, said upper sealing device and said upper pipe gripping device being supported by said telescopic jack so as to be vertically displaceable by extension and retraction of said telescopic jack.

18. The apparatus as claimed in claim 17, wherein said telescopic jack, said upper and lower pipe gripping devices and said upper and lower sealing devices are connected together as a telescopic snubbing jack assembly.

19. The apparatus as claimed in claim 15, wherein said pressure equalization duct communicates with an equalizer and bleed-off spool.

20. The apparatus as claimed in claim 15, further comprising a jack assembly connected to said upper sealing device for raising and lowering said upper sealing device.

21. A wellhead assembly, comprising:

upper and lower pipe sealing devices;

a pressure equalizing spool;

a vertically expansible and retractable housing;

said housing and said pressure equalizing spool being between said upper and lower sealing devices;

a pressure equalizing duct interconnecting said pressure equalizing spool and a well casing; and a snubbing jack above said housing.

22. The wellhead assembly as claimed in claim 21, including a bleed-off duct connected to said pressure equalizing spool and a bleed-off valve in said bleed-off duct.

23. The wellhead assembly as claimed in claim 21, wherein said lower sealing device comprises a double-gate blowout preventer, said double-gate blowoff preventer including safety rams and blind rams.

24. A wellhead assembly, comprising:

a snubbing jack assembly;

said snubbing jack assembly comprising upper and lower pipe gripping devices, a sealing device on said upper pipe gripping device, and a telescopically extensible and retractable cylinder between said upper and lower pipe gripping devices, said cylinder having a through bore for receiving a tool assembly on a pipe;

a lower sealing device below said snubbing jack assembly;

a pressure equalizing spool between said snubbing jack assembly and said lower sealing device;

a pressure equalizing duct extending around said lower sealing device and interconnecting said throughbore and a well bore; and a shut-off valve in said pressure equalizing duct.

25. The wellhead assembly as claimed in claim 24, wherein said cylinder comprises a hydraulic jack operable to raise and lower said upper pipe gripping device.

26. A method of inserting a pipe into a live well bore through upper and lower sealing devices at upper and lower ends of a housing, said method comprising the steps of:

a) maintaining pressure in said well bore by closure of said lower sealing device;

b) feeding said pipe downwardly into the housing to position a lower end of the pipe above the lower sealing device;

c) gripping the pipe below said housing;

d) telescopically extending said housing vertically along said pipe and raising said upper sealing device along said pipe;

e) closing said upper sealing device into sealing engagement with said pipe;

f) equalizing pressure in said housing with the pressure in said well bore;

g) opening said lower sealing device; and h) vertically retracting said housing and lowering said pipe past said lower sealing device.

27. The method as claimed in claim 26, which includes gripping the pipe below said housing prior to telescopically extending said housing and gripping the pipe above said housing and releasing the gripping of the pipe below the housing prior to opening said lower sealing device.

28. The method of as claimed in claim 26, which includes bleeding-off pressure from said housing prior to the step of vertically telescopically extending said housing.

29. The method as claimed in claim 26, in which said upper sealing device is raised and lowered by the extending and retracting of said housing.

30. The method as claimed in claim 26, in which the step of feeding said pipe downwardly towards said well bore comprises lowering tools on a lower end of said pipe into said housing.

31. The method as claimed in claim 26, in which the step of feeding said pipe downwardly towards said well bore includes lowering a portion of said pipe through said lower sealing device and thereby lowering towards said housing tools which are provided on said pipe above said portion.

32. The method as claimed in claim 31, which includes lowering said tools to a position above said upper sealing device, closing said lower sealing device into sealing engagement with said pipe beneath said tools, bleeding-off pressure from said housing, and opening said upper sealing device before the step of vertically telescopically extending said housing and which includes raising said upper sealing device past said tools by the telescopic extension of said housing.

33. A method of inserting tools attached to a pipe into a live well bore through upper and lower sealing devices provided at upper and lower ends of a telescopically extensible and retractable housing comprising the steps of:

a) lowering said pipe to position said tools above said upper sealing device;

b) gripping said pipe below said housing;

c) closing said lower sealing device into sealing engagement with said pipe below said housing to maintain pressure in said well bore;

d) bleeding-off pressure from between said upper and lower sealing devices;

e) raising said upper sealing device along said pipe to a position above said tools and telescopically extending said housing to enclose said tools therein;

f) closing said upper sealing device into sealing engagement with said pipe;

g) equalizing pressure between said upper and lower sealing devices with the pressure in said well bore;

j) opening said lower sealing device and said lower gripping device; and k) telescopically contracting said housing to lower said tools past said lower sealing device into said well bore.

34. The method as claimed in claim 33, in which step e) comprises employing hydraulic telescopic extension of said housing to raise said upper sealing device upwardly past said tools.

* * * * *